US012522407B2

(12) United States Patent
Madanat

(10) Patent No.: US 12,522,407 B2
(45) Date of Patent: Jan. 13, 2026

(54) MATERIAL DISPENSING DEVICE

(71) Applicant: Sahar Madanat, Amman (JO)

(72) Inventor: Sahar Madanat, Amman (JO)

( * ) Notice: Subject to any disclaimer, the term of this patent is extended or adjusted under 35 U.S.C. 154(b) by 194 days.

(21) Appl. No.: 17/775,511

(22) PCT Filed: Nov. 6, 2020

(86) PCT No.: PCT/JO2020/050010
§ 371 (c)(1),
(2) Date: May 9, 2022

(87) PCT Pub. No.: WO2021/090348
PCT Pub. Date: May 14, 2021

(65) Prior Publication Data

US 2022/0411141 A1 Dec. 29, 2022

Related U.S. Application Data

(60) Provisional application No. 62/931,821, filed on Nov. 7, 2019.

(51) Int. Cl.
*B65D 47/00* (2006.01)
*A47G 19/18* (2006.01)
(Continued)

(52) U.S. Cl.
CPC ..... *B65D 47/2031* (2013.01); *A47G 19/183* (2013.01); *B65D 85/72* (2013.01); *B65D 2547/063* (2013.01)

(58) Field of Classification Search
CPC ..... B65D 35/38; B65D 47/2031; B65D 35/00–22
See application file for complete search history.

(56) References Cited

U.S. PATENT DOCUMENTS 1,738,080 A * 12/1929 Smith ..... B65D 47/2031 222/541.2
2,272,653 A * 2/1942 Andrews ..... B65D 47/2031 222/490
(Continued)

FOREIGN PATENT DOCUMENTS

EP 0 287 530 A2 10/1988
EP 1 656 860 A1 5/2006
(Continued)

OTHER PUBLICATIONS

Planar Definition & Meaning—Merriam-Webster.pdf; obtained on Oct. 16, 2024 from: https://www.merriam-webster.com/dictionary/planar.*
(Continued)

*Primary Examiner* — Paul R Durand
*Assistant Examiner* — Randall A Gruby
(74) *Attorney, Agent, or Firm* — Oblon, McClelland, Maier & Neustadt, L.L.P.

(57) ABSTRACT

There is provided a material dispensing device that may include a first flexible hollow housing (5); a second flexible hollow housing (7), each of the first and second flexible hollow housings (5, 7) may have a proximal end (50, 70) and a distal end (51, 71); and a removable connector (6) configured to be separably connected to the proximal ends (50, 70) of the first and second flexible hollow housings (5, 7), thus defining a first compartment and a second compartment. Each of the first and second flexible hollow housings (5, 7) may have one or more slits (500, 700) in proximity to a corresponding distal end (51, 71), wherein each of the one or more slits (500, 700) may have a normally closed state and may be configured to open only when a user applies a manual lateral force to external surfaces of the first and/or second flexible hollow housings (5, 7) in proximity to a corresponding distal end (51, 71), thus allowing materials
(Continued)

enclosed in the first and/or second compartments to pass through the one or more slits (500, 700) to the outside of such compartments.

24 Claims, 18 Drawing Sheets

(51) Int. Cl.
*B65D 47/20* (2006.01)
*B65D 85/72* (2006.01)

(56) References Cited

U.S. PATENT DOCUMENTS 2,488,854 A * 11/1949 Crane ..... A47G 19/24 222/215
2,546,709 A * 3/1951 Abarr ..... B65D 47/2031 222/490
2,611,515 A 9/1952 Smith
2,904,225 A * 9/1959 Earles, Jr. ..... B65D 47/2031 222/212
3,063,601 A * 11/1962 Hertz ..... B65D 35/08 222/215
3,099,372 A * 7/1963 Taylor ..... A47G 19/24 222/509
3,179,301 A * 4/1965 Lucht ..... B65D 47/2031 215/11.1
3,570,726 A * 3/1971 Pomodoro ..... B65D 35/38 222/546
3,645,423 A * 2/1972 DeGraw ..... B65D 83/06 222/452
3,773,233 A * 11/1973 Souza ..... B65D 47/2031 222/490
4,109,836 A * 8/1978 Falarde ..... B65D 47/2031 239/533.13
4,148,420 A * 4/1979 Morrissette ..... B65D 47/2031 137/846
4,222,126 A * 9/1980 Boretos ..... A61F 2/2412 137/849
4,492,253 A * 1/1985 Raftis ..... F16K 15/147 137/849
5,105,997 A * 4/1992 Wakabayashi ..... F16K 15/147 239/DIG. 12
5,971,225 A * 10/1999 Kapsa ..... B65B 7/14 215/311
6,382,255 B2 * 5/2002 McFarland ..... F16K 15/147 137/849
7,077,296 B2 * 7/2006 Brown ..... B65D 47/2031 222/212
7,306,128 B2 * 12/2007 Eimer ..... B65D 47/2031 222/490
7,445,028 B1 * 11/2008 Aanonsen ..... F16K 15/147 137/849
7,682,389 B2 * 3/2010 Beith ..... A61F 2/2412 623/2.17
7,740,155 B1 * 6/2010 Gallegos ..... B65D 35/36 222/494
7,874,467 B2 * 1/2011 Pardes ..... B05B 11/1005 222/326
8,701,928 B2 * 4/2014 Samson ..... B65D 47/2031 220/717
8,728,601 B2 * 5/2014 Hutts ..... B65D 35/08 428/542.8
8,770,449 B2 * 7/2014 Wellman ..... B65D 47/2031 222/490
8,844,572 B2 * 9/2014 Stanaland ..... F16K 15/147 137/849
9,609,969 B1 * 4/2017 Panec ..... F16K 21/04
10,335,561 B2 * 7/2019 Krüger ..... A61M 15/0013
10,772,722 B2 * 9/2020 Bluestein ..... A61F 2/2418
10,850,894 B2 * 12/2020 Vredevoogd ..... B65D 47/2031
11,202,697 B2 * 12/2021 Behan ..... A61F 2/0009
11,345,523 B2 * 5/2022 Campbell ..... A47G 19/2266
11,840,377 B2 * 12/2023 Pater ..... F16K 15/1471
2001/0055509 A1 12/2001 Rodgers
2003/0189067 A1 * 10/2003 Stull ..... B65D 47/2031 222/494
2006/0065132 A1 * 3/2006 Jongen ..... B65D 83/771 99/485
2007/0187429 A1 * 8/2007 Farahmand ..... B65D 35/22 222/94
2010/0163584 A1 * 7/2010 Wellman ..... B65D 47/2031 222/494
2011/0315024 A1 * 12/2011 Ouriev ..... A23G 3/0257 137/511
2012/0205404 A1 * 8/2012 Massey ..... B65D 35/24 222/107
2017/0336234 A1 * 11/2017 Pater ..... G01F 15/005
2022/0153486 A1 * 5/2022 Pater ..... B65D 47/2031
2022/0411141 A1 * 12/2022 Madanat ..... B65D 85/72
2023/0095949 A1 * 3/2023 Van De Ven ..... B65D 51/2821 222/1

FOREIGN PATENT DOCUMENTS

NL 1001845 C2 6/1997
WO WO 91/16145 A1 10/1991
WO WO 03/063656 A1 8/2003

OTHER PUBLICATIONS

Proximity Definition & Meaning—Merriam-Webster.pdf; obtained on Oct. 16, 2024 from: https://www.merriam-webster.com/dictionary/proximity.*
Proximate Definition & Meaning—Merriam-Webster.pdf; obtained on Oct. 16, 2024 from: https://www.merriam-webster.com/dictionary/proximate.*
International Search Report and Written Opinion mailed on Dec. 14, 2020 in PCT/JO2020/050010 filed on Nov. 6, 2020.

* cited by examiner

MATERIAL DISPENSING DEVICE

CROSS-REFERENCE TO RELATED APPLICATIONS

This application claims priority to the U.S. Provisional Patent Application No. 62/931,821 filed on Nov. 7, 2019, which is herein incorporated by reference.

TECHNICAL FIELD

The present disclosure relates to material dispensing devices, and more particularly to material dispensing devices that minimize the use of materials and mechanisms.

BACKGROUND INFORMATION

Material dispensing devices and apparatuses are widely disclosed in the prior art. For instance, the international application published under number WO1991016145 discloses a device for distributing seasoning materials (toppings) onto snack food items during their manufacture. The device utilizes a hopper for the seasoning material and a tube having one end in communication with the hopper and extending outwardly from the hopper. The tube has a feed section and a seasoning delivery section. The device includes a motor-driven auger extending from the hopper through the tube. Seasoning distribution apertures extend generally longitudinally from the beginning of the seasoning delivery section. The orientation of at least a portion of the seasoning distribution apertures changes progressively downwardly toward the bottom of the tube.

The international patent application published under number WO2003063656 discloses a dressing dispenser that includes a container equipped with an upper opening and which contains the dressing or oil; and a pipette- or similar-type dressing dosimeter which consists of a long tube having a small diameter that has an air inlet at the upper end and a bulged receptacle at the lower end. The lower end of said receptacle is provided with a second opening which is used to dispense liquid dressings or oil in order to season salads and other types of food.

The European patent application publication EP 1656860 discloses a food seasoning quantitative dispenser that includes a body, a supporter, a center rod, a cap unit and a base. The body has a chamber for storing seasoning, and a conical neck. The supporter has plural feet, an annular wall, a central tubular member and an outlet between the feet, and located under the conical neck. The center rod has two flanges, an annular groove between the flanges, and a bottom hole for a spring to fit in. The cap unit has a cap body, a button and a stop disc. When the button is pressed down, the center rod is moved down to let the seasoning fall down through the open bottom of the body and received in the base closed on the bottom of the body.

SUMMARY

It is therefore an object of the present disclosure to provide a material dispensing device that can be used for dispensing solid, liquid, semi-liquid foodstuff such as seasoning materials, toppings, syrups, powders, spices, or non-foodstuff such as glitters, or cosmetics formulated in solid, liquid, or semi-liquid forms.

Aspects of the present disclosure provide a material dispensing device that may include a first flexible hollow housing having a proximal end and a distal end; and a removable cap configured to be separably connected to the proximal end of the first flexible hollow housing, thus defining a first compartment configured to enclose foodstuff or non-foodstuff materials in solid, granular, powder, semi-liquid, or liquid forms, wherein first flexible hollow housing may have one or more slits in proximity to the distal end, the one or more slits may have a normally closed state and may be configured to open only when a user applies a manual lateral force to external surfaces of the first flexible hollow housing in proximity to the distal end, thus allowing enclosed materials to pass through the one or more slits to the outside of the first compartment.

In some aspects, the distal end may include a plurality of external ribs that may be configured to force the one or more slits to maintain a normally closed state when no lateral force is applied to external surfaces of the first flexible hollow housing.

In other aspects, each member of the plurality of external ribs may be configured to be displaced away from other members in the plurality of external ribs when a lateral force is applied to external surfaces of the first flexible hollow housing, thus allowing the one or more slits to open.

In aspects of the present disclosure, the one or more slits may have a cross shape and are collinear with a first central line of the first flexible hollow housing.

In some aspects, the one or more slits may be tangent to the distal end.

In other aspects, the one or more slits may be slightly displaced from the distal end towards the proximal end with a passageway defined between the one or more silts and the distal end.

In some aspects, the first flexible hollow housing may further include a first lip in proximity to the proximal end.

In some aspects, the first flexible hollow housing may further include one or more recesses in proximity to the distal end.

In some aspects, a thickness of a wall of the first flexible hollow housing may gradually decrease as going from the proximal end towards the distal end.

In some aspects, the first flexible hollow housing may further include a first set of plurality of internal ribs longitudinally distributed along a circumference of an inner surface of the first flexible hollow housing in proximity to the proximal end.

In aspects of the present disclosure, the first flexible hollow housing may be made of an elastomer.

In some aspects, the removable cap may be made of a rigid material selected from wood, aluminum, plastic, or stainless steel, and may include a base, a first protrusion extending perpendicularly from the base, and a first flange extending radially outwardly from the first protrusion.

In some aspects, the first protrusion may be configured to be circumfused by a first lip.

Other aspects of the present disclosure provide a material dispensing device that may include a first flexible hollow housing having a proximal end and a distal end; a second flexible hollow housing having a proximal end and a distal end; and a removable connector configured to be separably connected to the proximal ends of the first and second flexible hollow housings, thus defining a first compartment and a second compartment, each of the first and second compartments are configured to enclose foodstuff or non-foodstuff materials in solid, granular, powder, semi-liquid, or liquid forms, wherein each of the first and second flexible hollow housings may have one or more slits in proximity to a corresponding distal end, and each of the one or more slits may have a normally closed state and may be configured to open only when a user applies a manual lateral force to external surfaces of the first and/or second flexible hollow housings in proximity to a corresponding distal end, thus allowing enclosed materials to pass through the one or more slits to the outside of the first and/or second compartments.

In some aspects, each of the distal ends of the first and second flexible hollow housings may include a plurality of external ribs configured to force the one or more slits to maintain a normally closed state when no lateral force is applied to external surfaces of the first and/or second flexible hollow housings.

In some aspects, each member of the plurality of external ribs may be configured to be displaced away from other members in the plurality of external ribs when a lateral force is applied to external surfaces of the first and/or second flexible hollow housings, thus allowing the one or more slits in the first and/or second flexible hollow housings to open.

In some aspects, each of the one or more slits may have a cross shape and may be collinear with a first central axis line and/or a second axis line of the first and/or second flexible hollow housings.

In some aspects, each of the one or more slits may be tangent to a corresponding distal end.

In other aspects, each of the one or more slits may be slightly displaced from a corresponding distal end towards the proximal end with a passageway defined between the each of the one or more silts and corresponding distal end.

In some aspects, the first flexible hollow housing may further include a first lip in proximity to the proximal end of the first flexible hollow housing, and wherein the second flexible hollow housing may include a second lip in proximity to the proximal end of the second flexible hollow housing.

In some aspects, each of the first flexible hollow housing and the second flexible hollow housing may further include one or more recesses in proximity to the distal ends.

In some aspects, a thickness of a wall of the first and second flexible hollow housing gradually may decrease as going from a corresponding proximal end towards a corresponding distal end.

In some aspects, each of the first flexible hollow housing and the second flexible hollow housing may further include a plurality of internal ribs longitudinally distributed along a circumference of an inner surface of a corresponding flexible hollow housing in proximity to a corresponding proximal end.

In aspects of the present disclosure, each of the first flexible hollow housing and the second flexible hollow housing may be made of an elastomer.

In some aspects, the removable connector may be made of a rigid material selected from wood, aluminum, plastic, or stainless steel, and may include a base, a first protrusion extending perpendicularly from the base, a first flange extending radially outwardly from the first protrusion, a second protrusion extending perpendicularly from the base in an opposing direction to the first protrusion, and a second flange extending radially outwardly from the second protrusion.

In some aspects of the present disclosure, the first protrusion may be configured to be circumfused by a first lip, and the second protrusion may be configured to be circumfused by a second lip.

BRIEF DESCRIPTION OF THE DRAWINGS

The disclosure will now be described with reference to the accompanying drawings, which illustrate embodiments of the disclosure, without however limiting the scope of protection thereto, and in which.

DETAILED DESCRIPTION

FIGS. 1-16 illustrate a material dispensing device configured in accordance with embodiments of the present disclosure, wherein the device is capable of dispensing an enclosed material in solid, liquid, or semi-liquid form, wherein the enclosed material may be a food stuff material or a non-foodstuff material.

Figure 1:
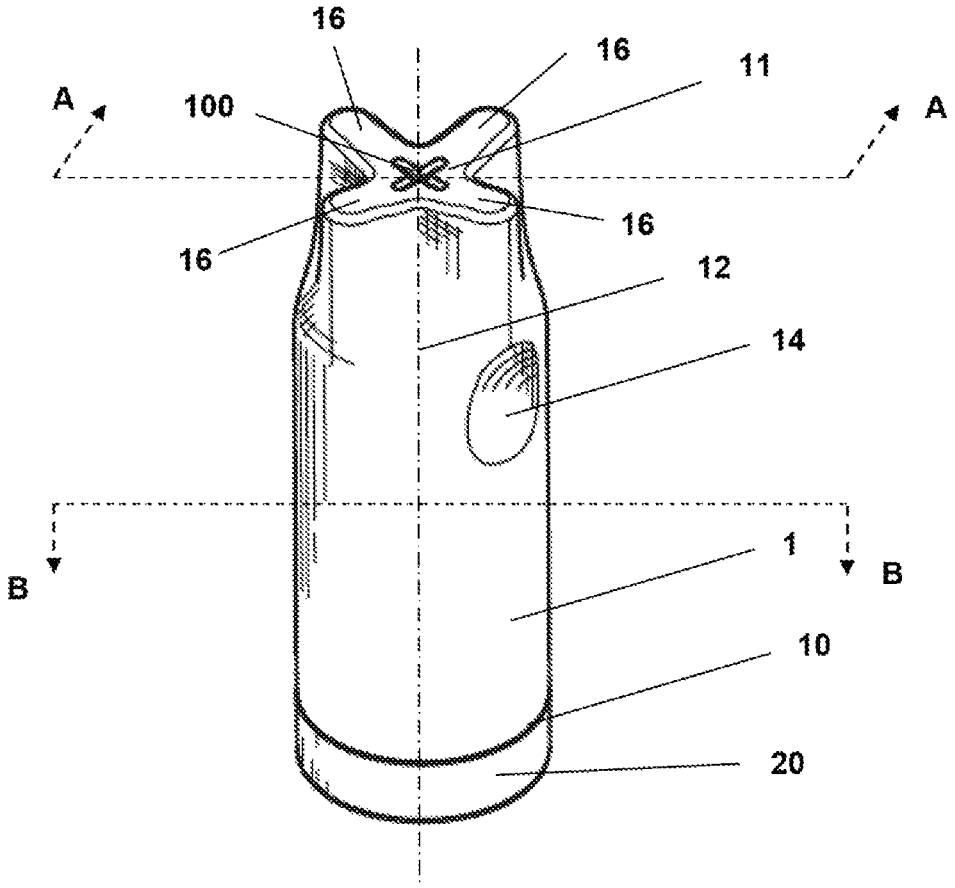
FIG. 1 illustrates a perspective view of a material dispensing device configured in accordance with one or more embodiments of the present disclosure.
Figure 2:
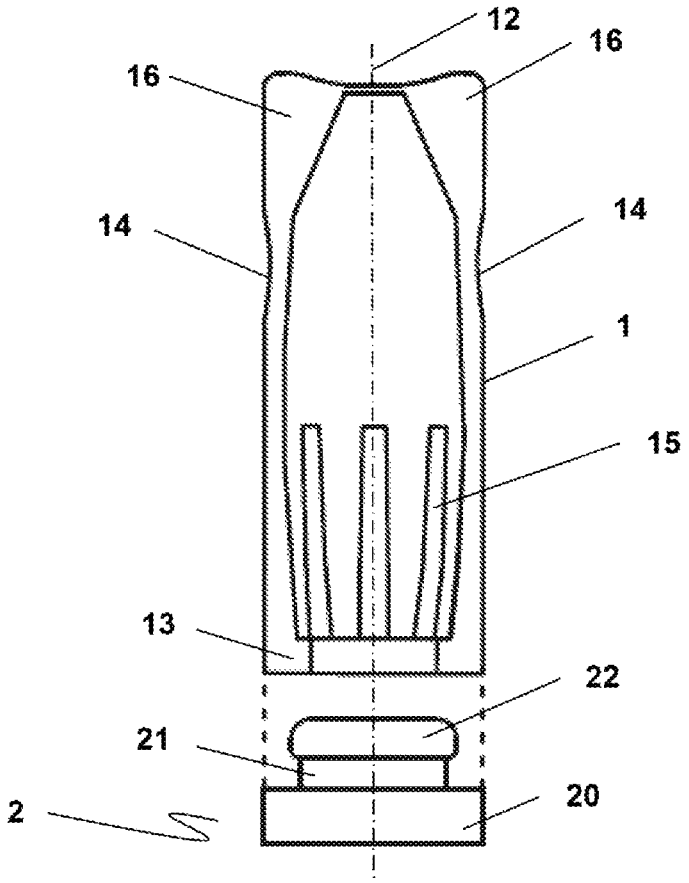
FIG. 2 illustrates an exploded cross-sectional view of a material dispensing device configured in accordance with one or more embodiments of the present disclosure, wherein the cross-section is taken through the line A-A of FIG. 1.

Reference is now being made to FIGS. 1-4 in some embodiments, wherein the material dispensing device may include a first flexible hollow housing 1 that may include a wall with a proximal end 10 and a distal end 11 having one or more slits 100, a first lip 13 in proximity to the proximal end 10, a first set of plurality of internal ribs 15 distributed longitudinally within an inner surface of the first flexible housing wall and in proximity to the proximal end 10, and a first set of plurality of external ribs 16 in proximity to the distal end 11. FIGS. 1 and 2 further illustrate a central axis line 12 for purposes of describing various features. The first set of plurality of internal ribs 15 may be configured to provide anchoring means to at least a portion of the inside surface of the first flexible hollow housing 1. The material dispensing device may also include a removable cap 2 configured to be separably connected to the proximal end 10 of the first flexible hollow housing 1 to define a first compartment, the removable cap 2 may include a base 20 with a first protrusion 21 extending perpendicularly therefrom, and a first flange 22 extending radially outwardly from the first protrusion 21. In embodiments of the present disclosure, the first lip 13 may be configured to circumfuse the first protrusion 21 of the removable cap 2. This allows for securely connecting the removable cap 2 to the first flexible hollow housing 1 in a separable manner, while preventing the enclosed material in the first compartment from leaking to the outside of the first compartment through the removable cap 2.

External surface of the first flexible hollow housing wall in embodiments of the present disclosure may include one or more recesses 14 in proximity to the distal end 11.

Figure 3A:
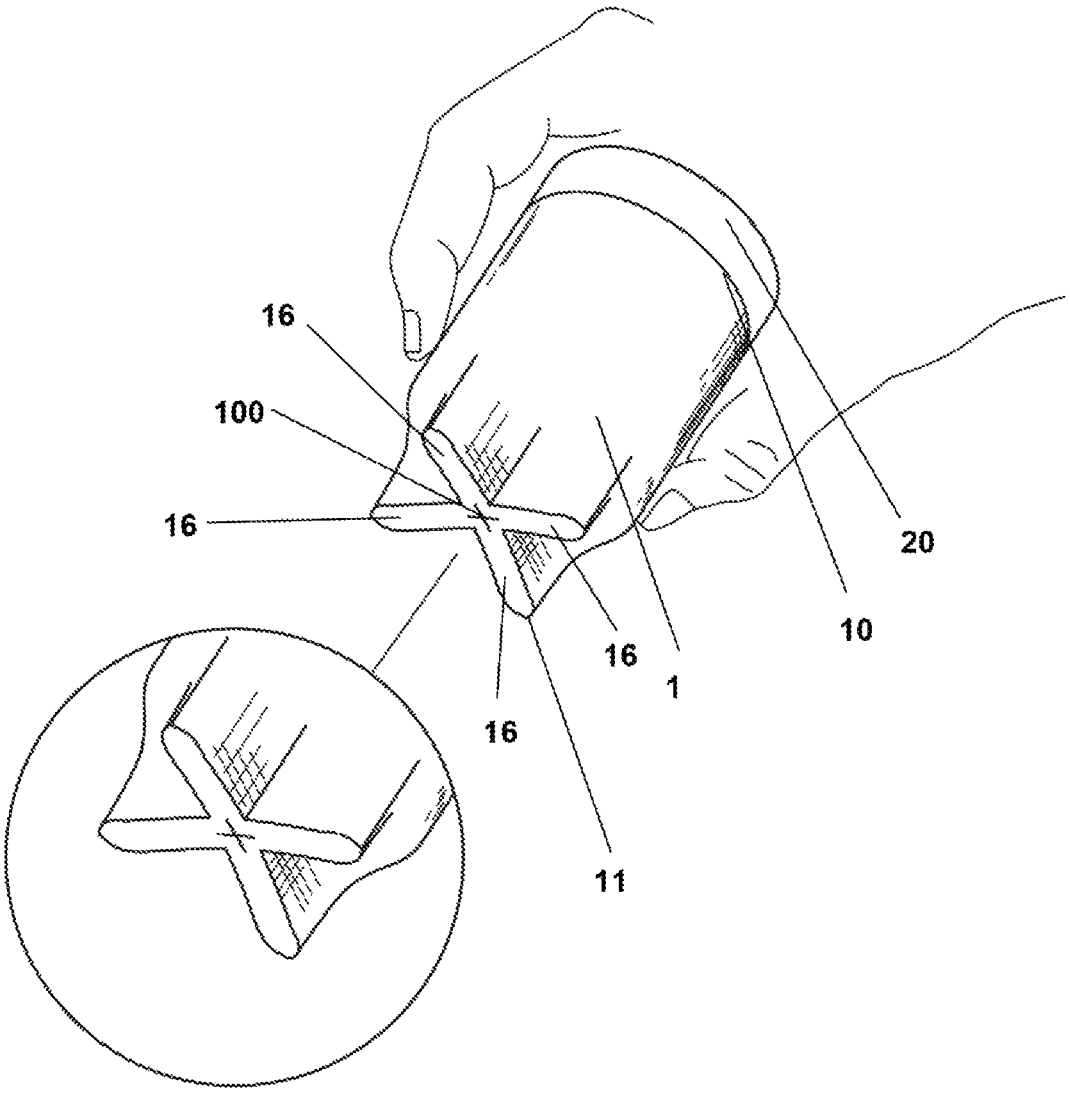
FIG. 3A illustrates a perspective view of a material dispensing device held by a user, the material dispensing device being configured in accordance with one or more embodiments of the present disclosure.

In embodiments of the present disclosure, the one or more slits 100 may have a cross shape and may be collinear with the first central line axis 12. Also, the one or more slits 100 may be configured to be normally closed, i.e., when there is no lateral force applied in proximity to the distal end 11 (FIG. 3A). This may be structurally achieved by means of the first set of the plurality of external ribs 16, which provides support to the one or more slits 100 and forces the one or more slits 100 to be firmly closed. The normally closed state of the one or more slits 100 may prevent the enclosed material in the first compartment from being accidently dispensed to the outside of the first compartment through the one or more slits 100 when there is no lateral force being applied in proximity to the distal end 11.

Figure 3B:
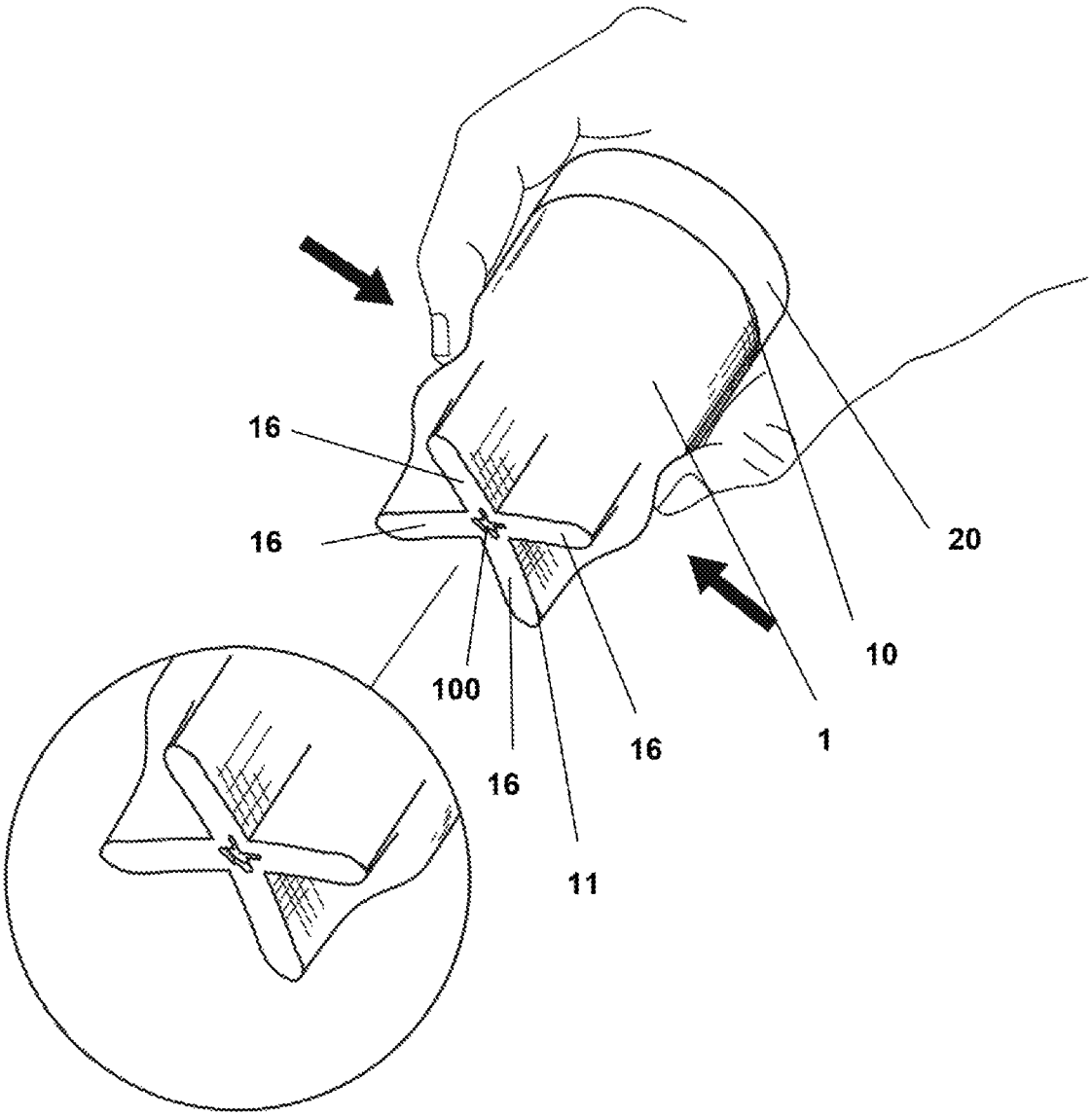
FIG. 3B illustrates a perspective view of a material dispensing device with a lateral force applied by a user's fingers, i.e. pinching force, to a flexible housing, the material dispensing device being configured in accordance with one or more embodiments of the present disclosure.
Figure 4:
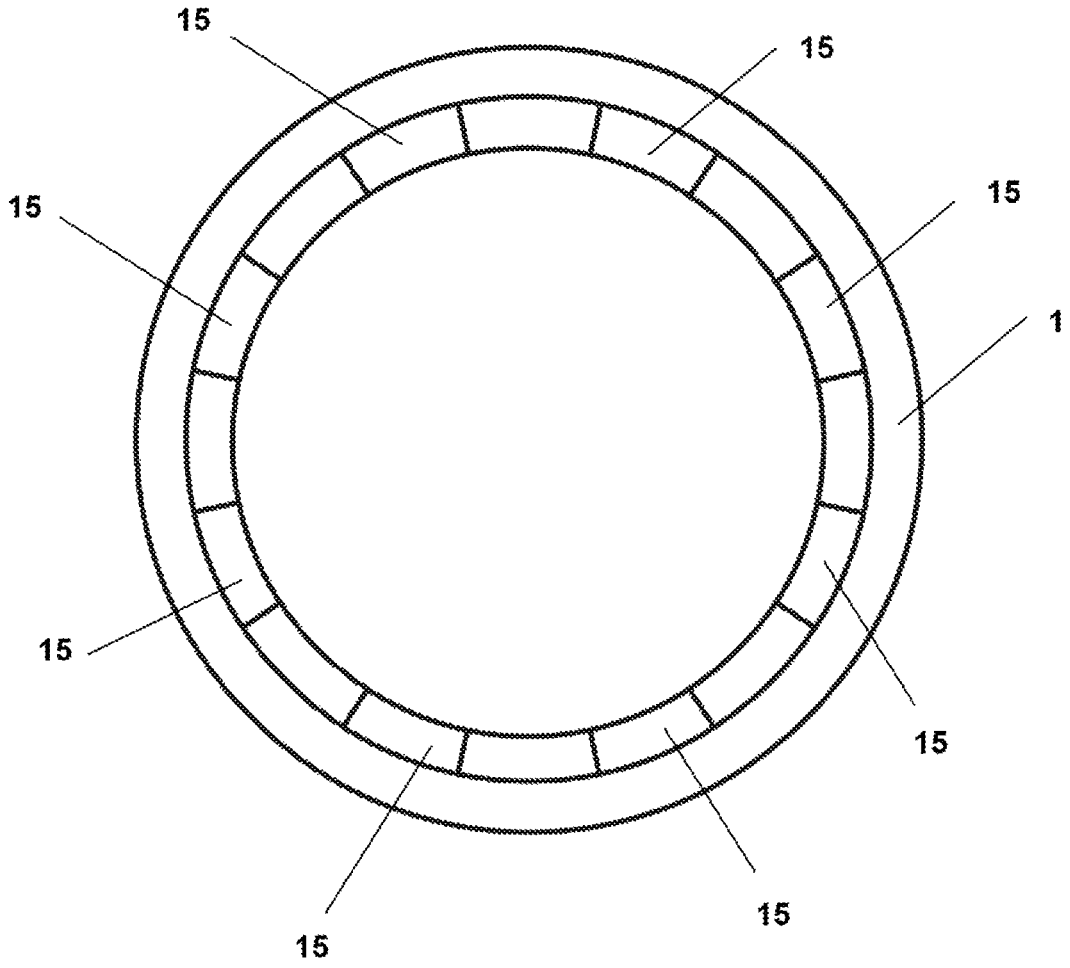
FIG. 4 illustrates a cross-sectional view of a material dispensing device configured in accordance with one or more embodiments of the present disclosure, wherein the cross-section is taken through the line B-B of FIG. 1.

In embodiments of the present disclosure, the one or more slits 100 may be configured to open when a user applies a lateral force, i.e., pinch, using his/her thumb and pointer fingers in proximity to the distal end 11, e.g., on the one or more recesses 14 (FIG. 3B). When the one or more slits 100 is open, and when the material dispensing device is oriented such that the distal end 11 has a lower elevation than the proximal end 10, the materials enclosed within the first compartment will flow by gravity to be dispensed to the outside of the first compartment through the one or more slits 100.

When a lateral force is applied in proximity to the distal end 11, e.g., on the one or more recesses 14, each member of the first set of plurality of external ribs 16 is forced to slightly move away, i.e., being displaced, from the other members. This forces the one or more slits 100 to open, thus providing a passageway for the enclosed material in the first compartment to be dispensed to the outside of such compartment through the one or more slits 100 (FIG. 3B).

In embodiments of the present disclosure, once the user releases the applied lateral force, each member of the first set of plurality of external ribs 16 returns to its default/original position and forces the one or more slits 100 to return to its normally closed position without allowing the enclosed material in the first compartment to pass through. This may allow the material dispensing device to be placed in various orientations while keeping the enclosed materials secure inside the first compartment.

The magnitude of displacement of each member of the first set of plurality of external ribs 16, and the degree of opening of the one or more slits 100 merely depend on the magnitude of the lateral force being applied in proximity to the distal end 11, e.g., on the one or more recesses 14. This may give the user control over flow rate of the dispensed materials. Therefore, depending on the magnitude of the applied lateral force, the user can release more or less materials from the dispensing device as he/she pleases. This may further allow for a simpler and more natural user experience, and improve the usability.

The one or more recesses 14 may act as a physical guide to the position where the lateral force has to be applied in order for the materials enclosed in the first compartment to be dispensed through the one or more slits 100. The one or more recesses 14 may also lower the magnitude of the lateral force that should be applied to the outer surface of first flexible housing 1 in order for the one or more slits 100 to open.

In embodiments of the present disclosure, the lateral wall thickness of the first flexible hollow housing 1 may gradually decrease as going from the proximal end 10 towards the distal end 11. This gradual decrease in thickness may render the proximal end 10 more rigid than the distal end 11. The difference in rigidity between the proximal end 10 and the distal end 11 may help in sustaining the connection between the removable cap 2 and the first flexible hollow housing 1 when the lateral force is applied in proximity to the distal end 11, thus preventing the dispensing device of the present disclosure from accidentally collapsing while in use. Additionally, the decrease in lateral wall thickness of the first hollow housing 1 may further provide support to keep the removable cap 2 static when lateral forces are applied to the first flexible hollow housing 1 in proximity to the proximal end 10.

The first set of plurality of internal ribs 15 may further provide structural support functions to make the proximal end 10 more rigid than the distal end 11 in order to prevent the dispensing device of the present disclosure from accidentally collapsing due to applied lateral forces on the first flexible hollow housing 1 in proximity to the distal end 11. Additionally, the first set of plurality of internal ribs 15 may further provide support to keep the removable cap 2 static when lateral forces are applied to the first flexible hollow housing 1 in proximity to the proximal end 10.

In other embodiments, the first flexible hollow housing 1 may also include a first groove (not shown) in proximity to the proximal end 10, wherein such first groove may be configured to receive a part of the first flange 22 in order to secure a separable connection between the removable cap 2 and the first flexible hollow housing 1.

Refilling the material in the first compartment may be achieved by simply detaching/disconnecting the first flexible hollow housing 1 from the removable cap 2, filling the first flexible hollow housing 1 with the material through the proximal end 10, and reattaching/reconnecting the first flexible hollow housing 1 to the removable cap 2. Due to the fact that the one or slits 100 remains naturally closed due to the material properties and geometry of the first hollow housing 1, refilling the material dispensing device will not accidentally release any enclosed material, allowing for a mess free experience.

Figure 5:
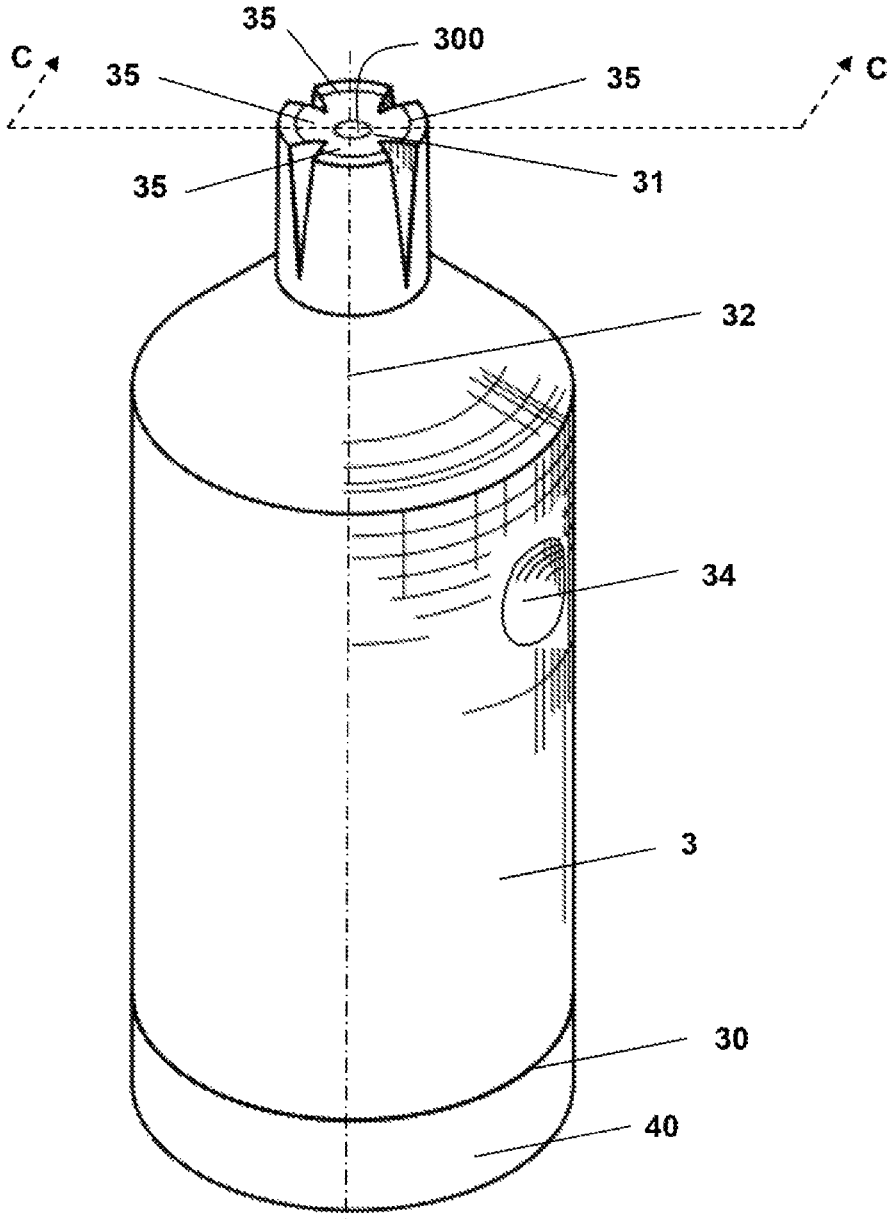
FIG. 5 illustrates a perspective view of a material dispensing device configured in accordance with one or more embodiments of the present disclosure.
Figure 6:
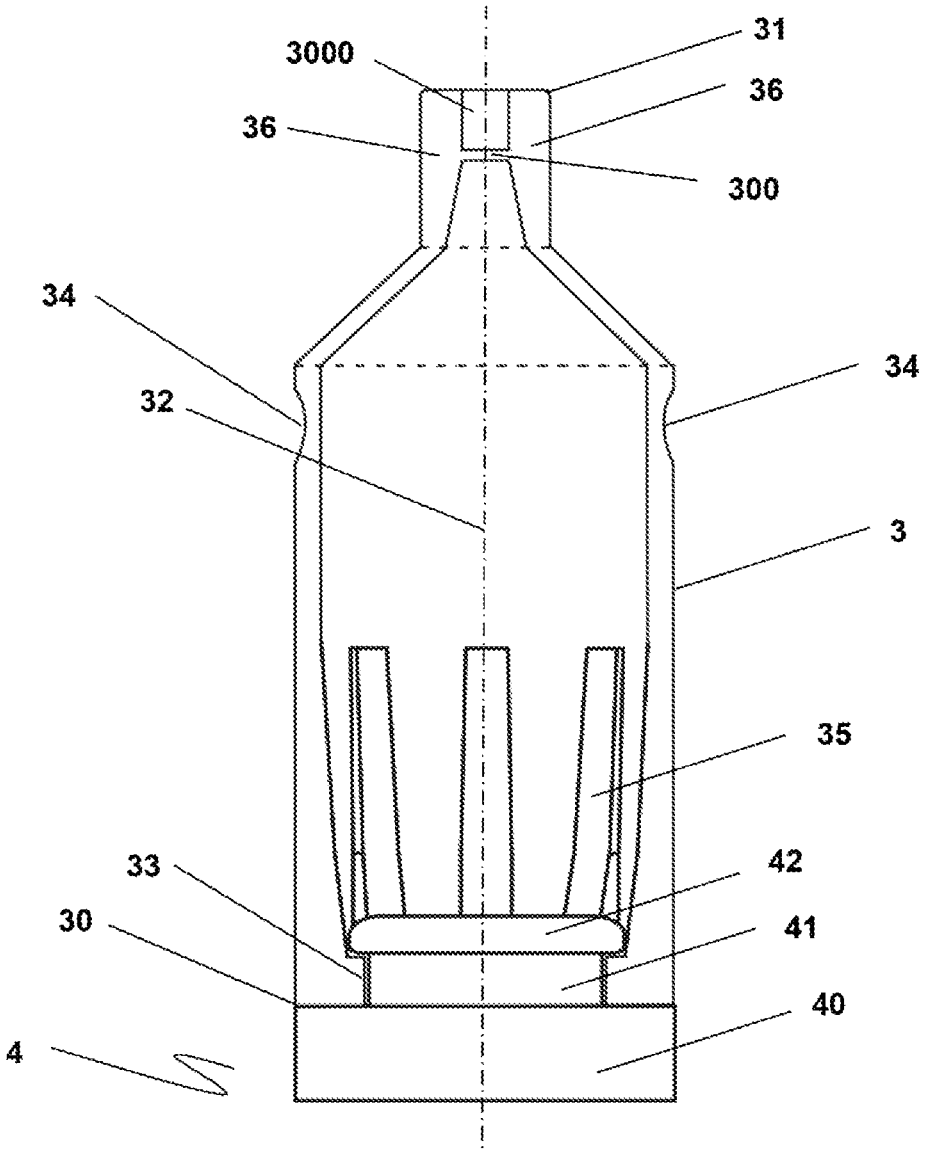
FIG. 6 illustrates a cross-sectional view of a material dispensing device configured in accordance with one or more embodiments of the present disclosure, wherein the cross-section is being taken through the line C-C of FIG. 5.

Reference is now being made to FIGS. 5-8, which illustrate other embodiments of a material dispensing device of the present disclosure. The material dispensing device may include a first flexible hollow housing 3 that may include a wall with a proximal end 30 and a distal end 31 having one or more slits 300, a first lip 33 in proximity to the proximal end 30, a first set of plurality of internal ribs 35 distributed longitudinally within an inner surface of the first flexible housing and in proximity to the proximal end 30, and a first set of plurality of external ribs 36 in proximity to the distal end 31. FIGS. 5 and 6 further illustrate a central axis line 32 for purposes of describing various features. The first set of plurality of internal ribs 35 may be configured to provide anchoring means to at least a portion of the inside surface of the first flexible hollow housing 3. The material dispensing device may also include a removable cap 4 configured to be separably connected to the proximal end 30 of the first flexible hollow housing 3 to define a first compartment, the removable cap 4 may include a base 40 with a first protrusion 41 extending perpendicularly therefrom, and a first flange 42 extending radially outwardly from the first protrusion 41. In embodiments of the present disclosure, the first lip 33 may be configured to circumfuse the first protrusion 41 of the removable cap 4. This allows for securely connecting the removable cap 4 to the first flexible hollow housing 3 in a separable manner, while preventing the enclosed material in the first compartment from leaking to the outside of the first compartment through the removable cap 4.

External surface of the first flexible hollow housing wall in embodiments of the present disclosure may include one or more recesses 34 in proximity to the distal end 31.

In some embodiments, the one or more slits 300 may have a cross shape (FIG. 8) and may be slightly displaced from the distal end 31 towards the proximal end 30 with a passageway 3000 defined between the one or more silts 300 and the distal end 31 (FIG. 6). This configuration may be suitable for dispensing liquid or semi-liquid material enclosed in the first compartment because the passageway 3000 may help in keeping the distal end 31 clean after dispensing the enclosed material, which facilitates the storage of the material dispensing device without the need of wiping the distal end 31 to keep it clean after use.

Figure 7A:
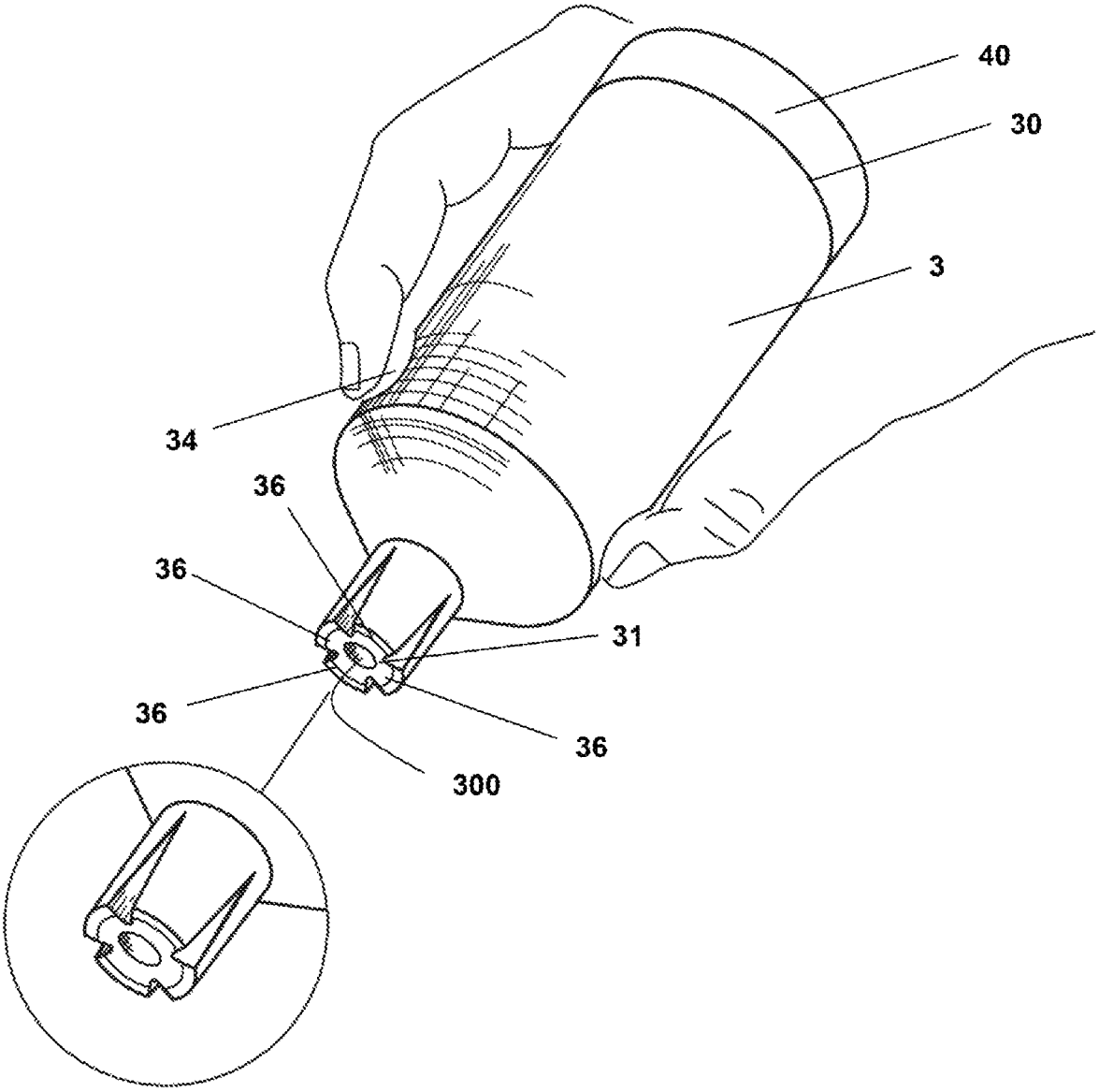
FIG. 7A illustrates a perspective view of a material dispensing device held by a user, the material dispensing device being configured in accordance with one or more embodiments of the present disclosure.

In embodiments of the present disclosure, the one or more slits 300 may be collinear with the first central line axis 32, and may be configured to be normally closed, i.e., when there is no lateral force applied in proximity to the distal end 31 (FIG. 7A). This may be structurally achieved by means of the first set of the plurality of external ribs 36, which provides support to the one or more slits 300 and forces the one or more slits 300 to be firmly closed. The normally closed state of the one or more slits 300 may prevent the enclosed material in the first compartment from being accidently dispensed to the outside of the first compartment through the one or more slits 300 when there is no lateral force being applied in proximity to the distal end 31.

Figure 7B:
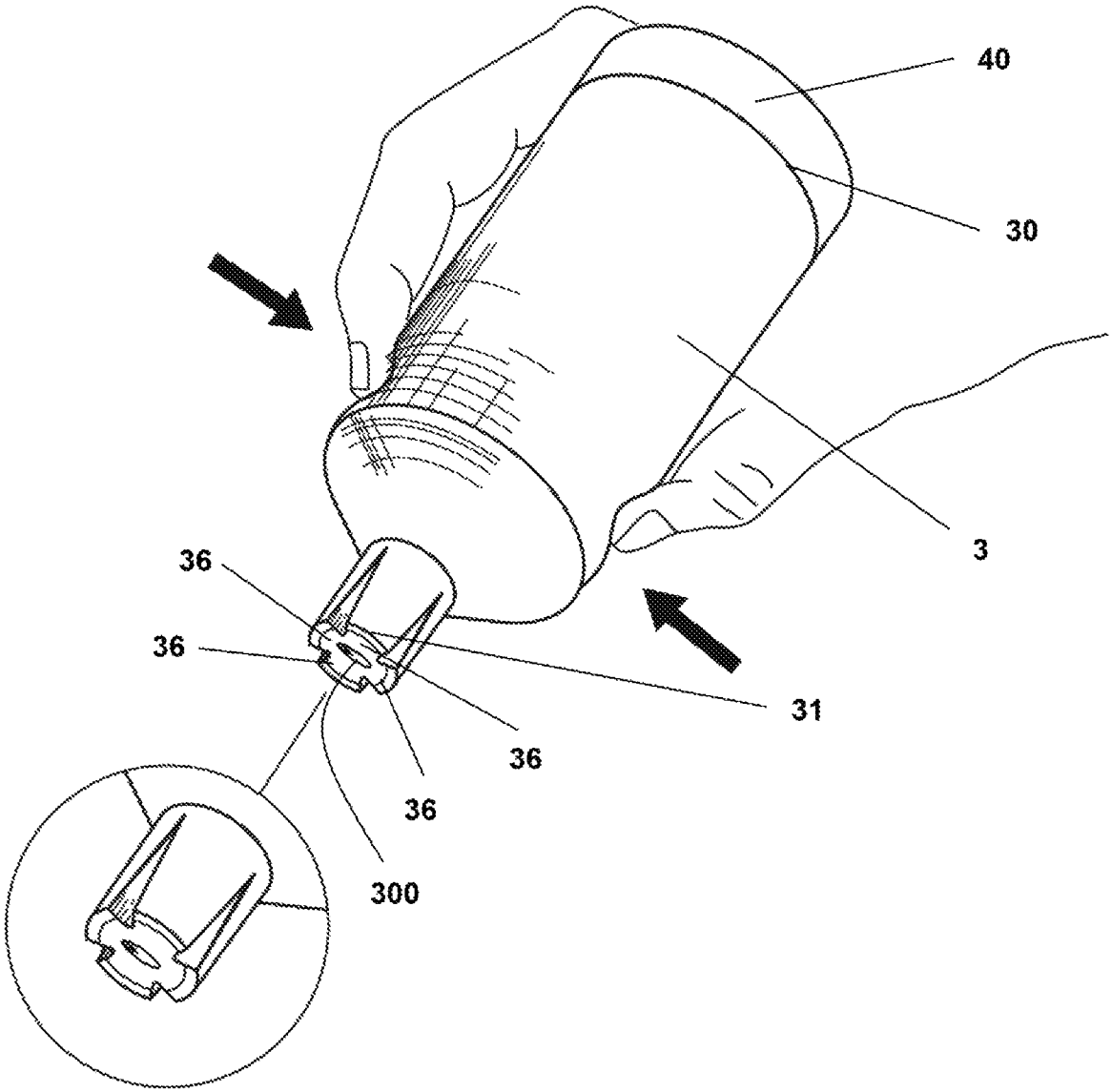
FIG. 7B illustrates a perspective view of a material dispensing device with a lateral force applied to a flexible housing by a user's fingers, i.e. pinching force, the material dispensing device being configured in accordance with one or more embodiments of the present disclosure.
Figure 8:
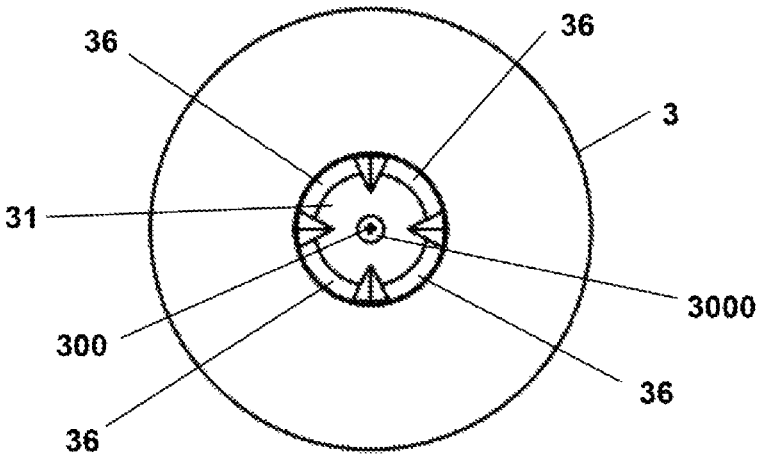
FIG. 8 illustrates a top view of a material dispensing device configured in accordance with one or more embodiments of the present disclosure.

In embodiments of the present disclosure, the one or more slits 300 may be configured to open when a user applies a lateral force, i.e., pinch, using his/her thumb and pointer fingers in proximity to the distal end 31, e.g., on the one or more recesses 34 (FIG. 7B). When the one or more slits 300 is open, and when the material dispensing device is oriented such that the distal end 31 has a lower elevation than the proximal end 30, the materials enclosed within the first compartment will flow by gravity to be dispensed from the first compartment through the one or more slits 300 to the outside of such compartment.

When a lateral force is applied in proximity to the distal end 31, e.g., on the one or more recesses 34, each member of the first set of plurality of external ribs 36 is forced to slightly move away, i.e., being displaced, from the other members. This forces the one or more slits 300 to open, thus providing a passageway for the enclosed material in the first compartment to be dispensed to the outside of such compartment through the one or more slits 300 (FIG. 7B).

In embodiments of the present disclosure, once the user releases the applied lateral force, each member of the first set of plurality of external ribs 36 returns to its default/original position and forces the one or more slits 300 to return to its normally closed position without allowing the enclosed material to pass through to the outside of the first compartment. This may allow the material dispensing device to be placed in various orientations while keeping the enclosed material secure inside the first compartment.

The magnitude of displacement of each member of the first set of plurality of external ribs 36, and the degree of opening of the one or more slits 300 merely depend on the magnitude of the lateral force being applied in proximity to the distal end 31, e.g., on the one or more recesses 34. This may give the user control over flow rate of the dispensed materials. Therefore, depending on the magnitude of the applied lateral force, the user can release more or less materials from the dispensing device as he/she pleases. This may further allow for a simpler and more natural user experience, and improve the usability.

The one or more recesses 34 may act as a physical guide to the position where the lateral force has to be applied in order for the material enclosed in the first compartment to be dispensed through the one or more slits 300. The one or more recesses 34 may also lower the magnitude of the lateral force that should be applied to the first flexible housing 3 in order for the one or more slits 300 to open.

In embodiments of the present disclosure, the lateral wall thickness of the first flexible hollow housing 3 may gradually decrease as going from the proximal end 30 towards the distal end 31. This gradual decrease in thickness may render the proximal end 30 more rigid than the distal end 31. The difference in rigidity between the proximal end 30 and the distal end 31 may help in sustaining the connection between the removable cap 4 and the first flexible hollow housing 3 when the lateral force is applied in proximity to the distal end 31, thus preventing the dispensing device of the present disclosure from accidentally collapsing while in use. Additionally, the decrease in lateral wall thickness of the first hollow housing 3 may further provide support to keep the removable cap 4 static when lateral forces are applied to the first flexible hollow housing 3 in proximity to the proximal end 30.

The first set of plurality of internal ribs 35 may further provide structural support functions to make the proximal end 30 more rigid than the distal end 31 in order to prevent the dispensing device of the present disclosure from accidentally collapsing due to applied lateral forces on the first flexible hollow housing 3 in proximity to the distal end 31. Additionally, the first set of plurality of internal ribs 35 may further provide support to keep the removable cap 4 static when lateral forces are applied to the first flexible hollow housing 3 in proximity to the proximal end 30.

In other embodiments, the first flexible hollow housing 3 may also include a first groove (not shown) in proximity to the proximal end 30, wherein such first groove may be configured to receive a part of the first flange 42 in order to secure a separable connection between the removable cap 4 and the first flexible hollow housing 3.

Refilling the material in the first compartment may be achieved by simply detaching/disconnecting the first flexible hollow housing 3 from the removable cap 4, filling the first flexible hollow housing 3 with the material through the proximal end 30, and reattaching/reconnecting the first flexible hollow housing 3 to the removable cap 4. Due to the fact that the one or slits 300 remains naturally closed due to the material properties and geometry of the first hollow housing 3, refilling the material dispensing device will not accidentally release any enclosed material, allowing for a mess free experience.

Figure 9:
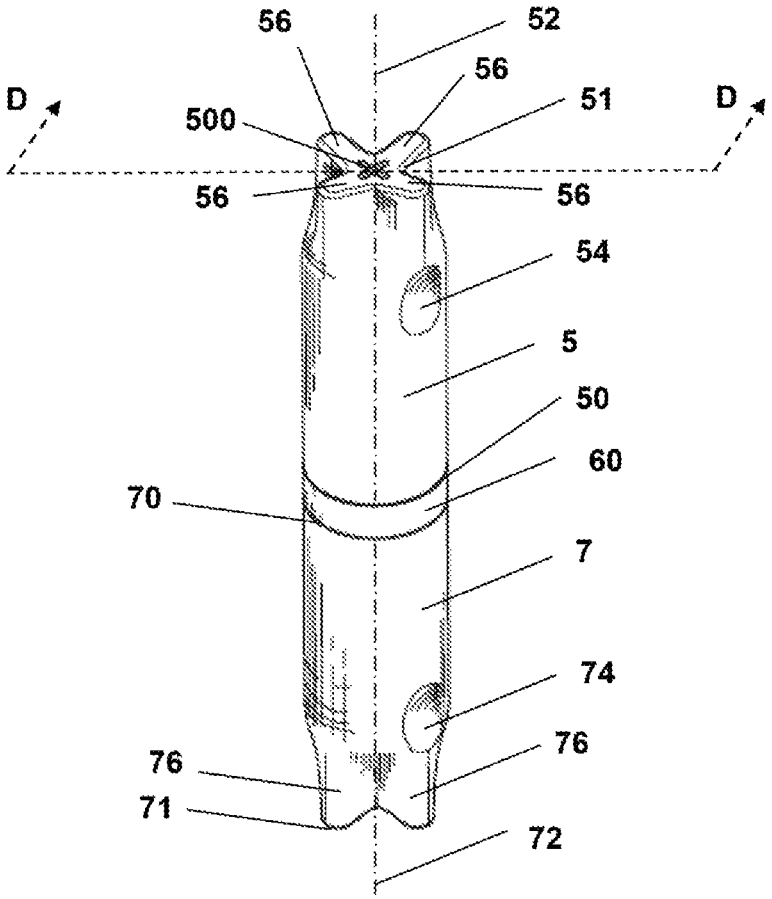
FIG. 9 illustrates an upper perspective view of a material dispensing device configured in accordance with one or more embodiments of the present disclosure.
Figure 10:
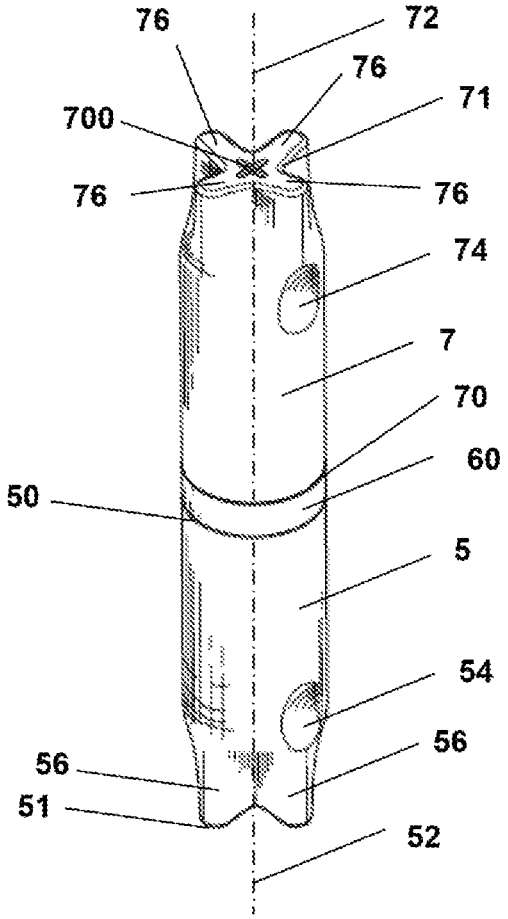
FIG. 10 illustrates a lower perspective view of a material dispensing device configured in accordance with one or more embodiments of the present disclosure.
Figure 11:
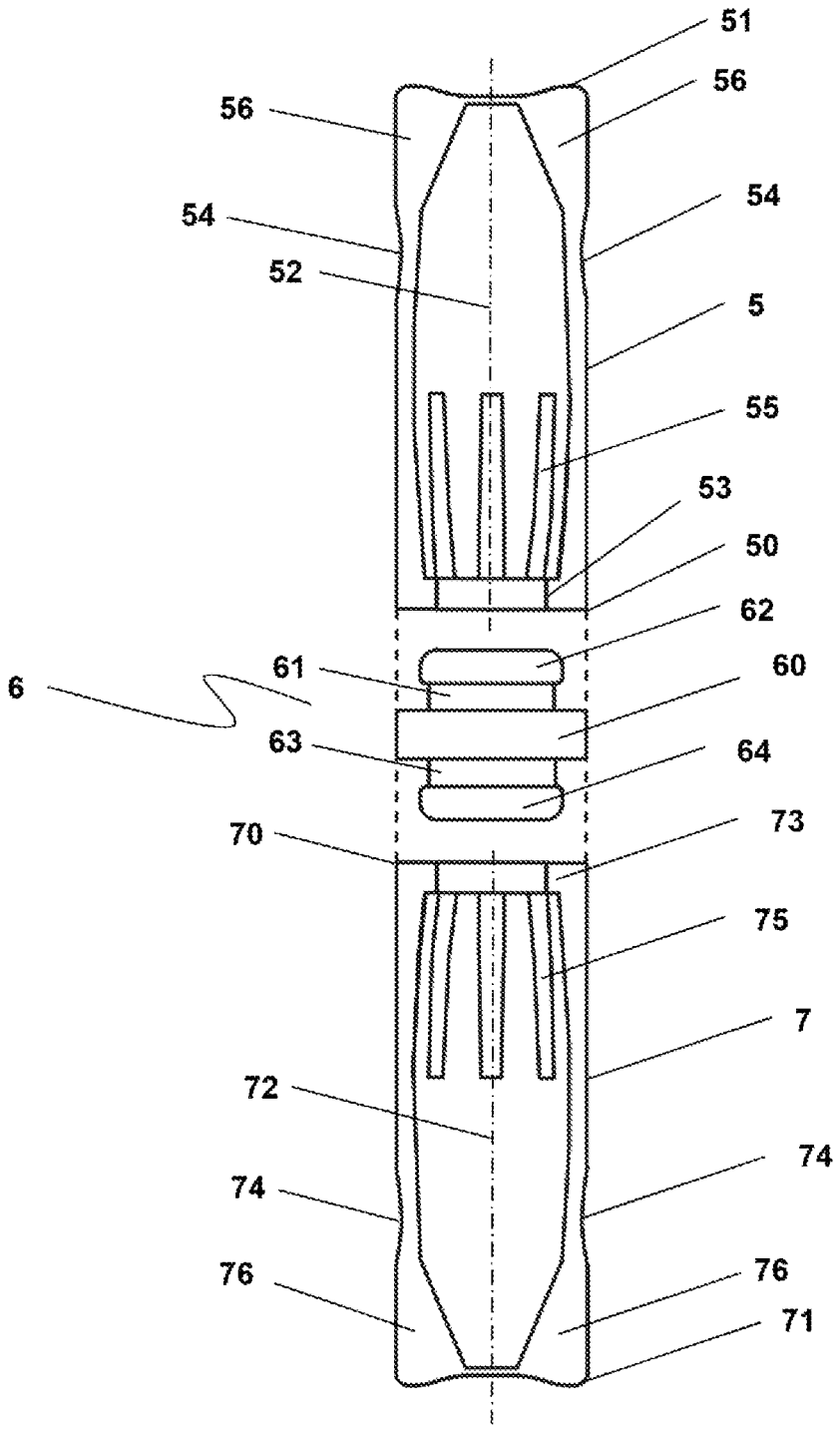
FIG. 11 illustrates an exploded cross-sectional view of a material dispensing device configured in accordance with one or more embodiments of the present disclosure, wherein the cross section is taken through the line D-D of FIG. 9.

Reference is now being made to FIGS. 9-11, which illustrate other embodiments of a material dispensing device of the present disclosure. The material dispensing device may include a first flexible hollow housing 5 that may include a wall with a proximal end 50 and a distal end 51 having one or more slits 500, a first lip 53 in proximity to the proximal end 50, a first set of plurality of internal ribs 55 distributed longitudinally within an inner surface of the first flexible housing wall and in proximity to the proximal end 50, and a first set of plurality of external ribs 56 in proximity to the distal end 51. The material dispensing device may further include a second flexible hollow housing 7 that may include a wall with a proximal end 70 and a distal end 71 having one or more slits 700, a second lip 73 in proximity to the proximal end 70, a second set of plurality of internal ribs 75 distributed longitudinally within an inner surface of the first flexible housing wall and in proximity to the proximal end 70, and a first set of plurality of external ribs 76 in proximity to the distal end 71. FIGS. 9-11 further illustrate a first central axis line 52, and a second central axis line 72 for purposes of describing various features. The first and second set of plurality of internal ribs 55, 75 may be configured to provide anchoring means to at least a portion of the inside surfaces of the first and second flexible hollow housings 5, 7, respectively. The material dispensing device may also include a removable connector 6 configured to be separably connected to the proximal ends 50, 70 of the first and second flexible hollow housings 5, 7 to define a first compartment and a second compartment within the first and second flexible hollow housings, respectively. The removable connector 6 may include a base 60 with a first protrusion 61 extending perpendicularly therefrom, and a first flange 62 extending radially outwardly from the first protrusion 61. The removable connector 6 may also include a second protrusion 63 extending perpendicularly from the base 60 in an opposed direction to the first protrusion 61, and a second flange 64 extending radially outwardly from the second protrusion 63. In embodiments of the present disclosure, the first lip 53 may be configured to circumfuse the first protrusion 61 of the removable connector 6, and the second lip 73 may be configured to circumfuse the second protrusion 63 of the removable connector 6. This allows for securely connecting the removable connector 6 to the first and second flexible hollow housings 5, 7 in a separable manner, while preventing the enclosed materials in the first and second compartments from leaking to the outside of such compartments through the removable connector 6.

External surfaces of the first and second flexible hollow housings' walls in embodiments of the present disclosure may include one or more recesses 54, 74 in proximity to the distal ends 51, 71, respectively.

In embodiments of the present disclosure, the one or more slits 500, 700 may have a cross shape, and may be collinear with the first and second central line axes 52, 72, respectively. The one or more slits 500, 700 may also be configured to be normally closed, i.e., when there is no lateral force applied in proximity to the distal ends 51, 71. This may be structurally achieved by means of the first set and second set of the plurality of external ribs 56, 76, which provide support to the one or more slits 500, 700 and forces them to be firmly closed. The normally closed state of the one or more slits 500, 700 may prevent the enclosed materials in the first and/or second compartments from being accidently dispensed to the outside of such compartments through the one or more slits 500, 700 when there is no lateral force being applied in proximity to the distal ends 51, 71.

In embodiments of the present disclosure, the one or more slits 500, 700 may be configured to open when a user applies a lateral force, i.e., pinch, using his/her thumb and pointer fingers in proximity to the distal ends 51, 71, e.g., on the one or more recesses 54, 74. When the one or more slits 500 is open, and when the material dispensing device is oriented such that the distal end 51 has a lower elevation than the proximal end 50, the material enclosed within the first compartment will flow by gravity to be dispensed from the first compartment to the outside of such compartment through the one or more slits 500. Similarly, when the one or more slits 700 is open, and when the material dispensing device is oriented such that the distal end 71 has a lower elevation than the proximal end 70, the material enclosed within the second compartment will flow by gravity to be dispensed from the second compartment to the outside of such compartnnet through the one or more slits 700.

When a lateral force is applied in proximity to the distal end 51, e.g., on the one or more recesses 54, each member of the first set of plurality of external ribs 56 is forced to slightly move away, i.e., being displaced, from the other members. This forces the one or more slits 500 to open, thus providing a passageway for the enclosed material in the first compartment to be dispensed to the outside of such compartment through the one or more slits 500. Similarly, when a lateral force is applied in proximity to the distal end 71, e.g., on the one or more recesses 74, each member of the first set of plurality of external ribs 76 is forced to slightly move away, i.e., being displaced, from the other members. This forces the one or more slits 700 to open, thus providing a passageway for the enclosed material in the second compartment to be dispensed to the outside of such compartment through the one or more slits 700.

In embodiments of the present disclosure, once the user releases the applied lateral force, each member of the first set of plurality of external ribs 56 and/or each member of the second plurality of external ribs 76 returns to its default/original position and forces the one or more slits 500, 700 to return to their normally closed position without allowing the enclosed materials in the first and/or second compartments to pass through. This may allow the material dispensing device to be placed in various orientations while keeping the enclosed materials secure inside the first and/or second compartments.

The magnitude of displacement of each member of the first set of plurality of external ribs 56, 76, and the degree of opening of the one or more slits 500, 700 merely depend on the magnitude of the lateral force being applied in proximity to the distal ends 51, 71, e.g., on the one or more recesses 54, 74. This may give the user control over flow rate of the dispensed materials. Therefore, depending on the magnitude of the applied lateral force, the user can release more or less materials from the dispensing device as he/she pleases. This may further allow for a simpler and more natural user experience, and improve the usability.

The one or more recesses 54, 74 may act as a physical guide to the position where the lateral force has to be applied in order for the materials enclosed in the first and/or second compartments to be dispensed through the one or more slits 500, 700. The one or more recesses 54, 74 may also lower the magnitude of the lateral force that should be applied to the first and second flexible housings 5, 7 in order for the one or more slits 500, 700 to open.

In embodiments of the present disclosure, the lateral wall thickness of the first and/or second flexible hollow housings 5, 7 may gradually decrease as going from the proximal ends 50, 70 towards the distal ends 51, 71, respectively. This gradual decrease in thickness may render the proximal ends 50, 70 more rigid than the distal ends 51, 71. The difference in rigidity between the proximal ends 50, 70 and the distal ends 51, 71 may help in sustaining the connection between the removable connector 6 and the first and second flexible hollow housings 5, 7 when the lateral force is applied in proximity to the distal ends 51, 71, thus preventing the dispensing device of the present disclosure from accidentally collapsing while in use. Additionally, the decrease in lateral wall thickness of the first and/or second hollow housings 5, 7 may further provide support to keep the removable connector 6 static when lateral forces are applied to the first and/or second flexible hollow housings 5, 7 in proximity to the proximal ends 50, 70.

The first and second sets of plurality of internal ribs 55, 75 may further provide structural support functions to make the proximal ends 50, 70 more rigid than the distal ends 51, 71 in order to prevent the dispensing device of the present disclosure from accidentally collapsing due to applied lateral forces on the first and/or second flexible hollow housings 5, 7 in proximity to the distal ends 51, 71. Additionally, the first and second sets of plurality of internal ribs 55, 75 may further provide support to keep the removable connector 4 static when lateral forces are applied to the first and/or second flexible hollow housings 5, 7 in proximity to the proximal ends 50, 70.

In other embodiments, the first flexible hollow housing 5 may also include a first groove (not shown) in proximity to the proximal end 50, wherein such first groove may be configured to receive a part of the first flange 62 in order to secure a separable connection between the removable connector 6 and the first flexible hollow housing 5.

Similarly, the second flexible hollow housing 7 may also include a second groove (not shown) in proximity to the proximal end 70, wherein such second groove may be configured to receive a part of the second flange 64 in order to secure a separable connection between the removable connector 6 and the second flexible hollow housing 7.

Refilling the materials in the first and/or second compartments may be achieved by simply detaching/disconnecting the first and/or second flexible hollow housings 5, 7 from the removable connector 6, filling the first and/or second flexible hollow housings 5, 7 with the materials through the proximal ends 50, 70, and reattaching/reconnecting the first and/or second flexible hollow housings 5, 7 to the removable connector 6. Due to the fact that the one or slits 500, 700 remains naturally closed due to the material properties and geometry of the first and second flexible hollow housings 5, 7, refilling the material dispensing device will not accidentally release any enclosed material, allowing for a mess free experience.

Figure 12:
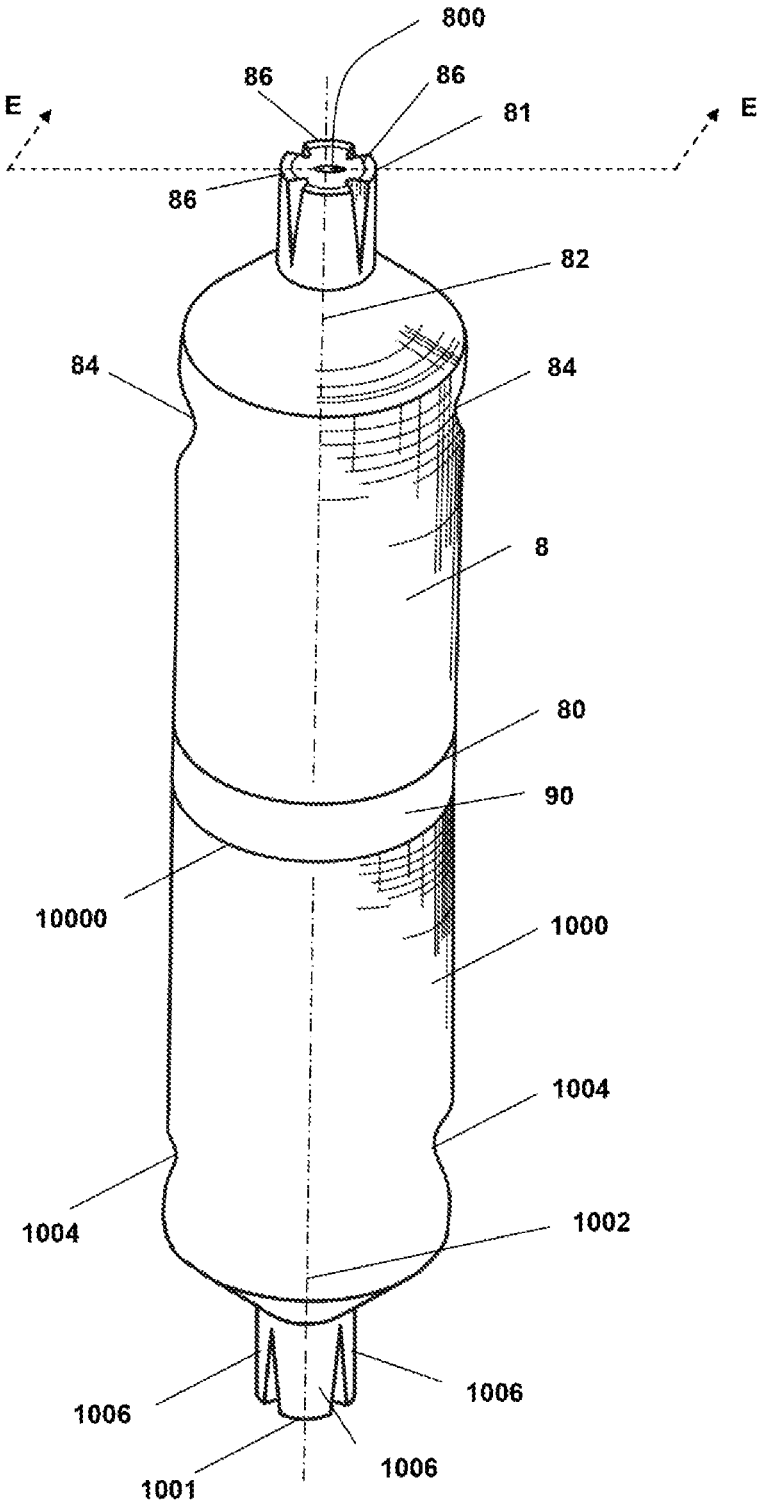
FIG. 12 illustrates an upper perspective view of a material dispensing device configured in accordance with one or more embodiments of the present disclosure.
Figure 13:
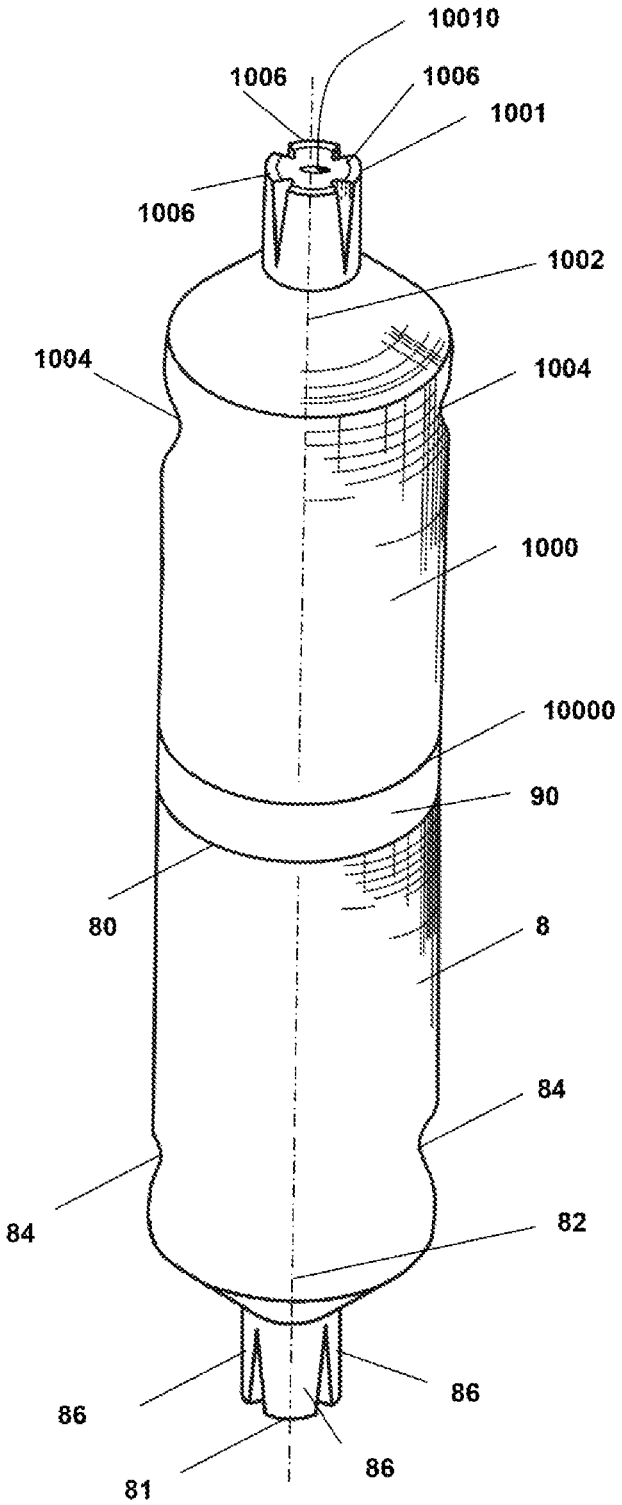
FIG. 13 illustrates a lower perspective view of a material dispensing device configured in accordance with one or more embodiments of the present disclosure.
Figure 14:
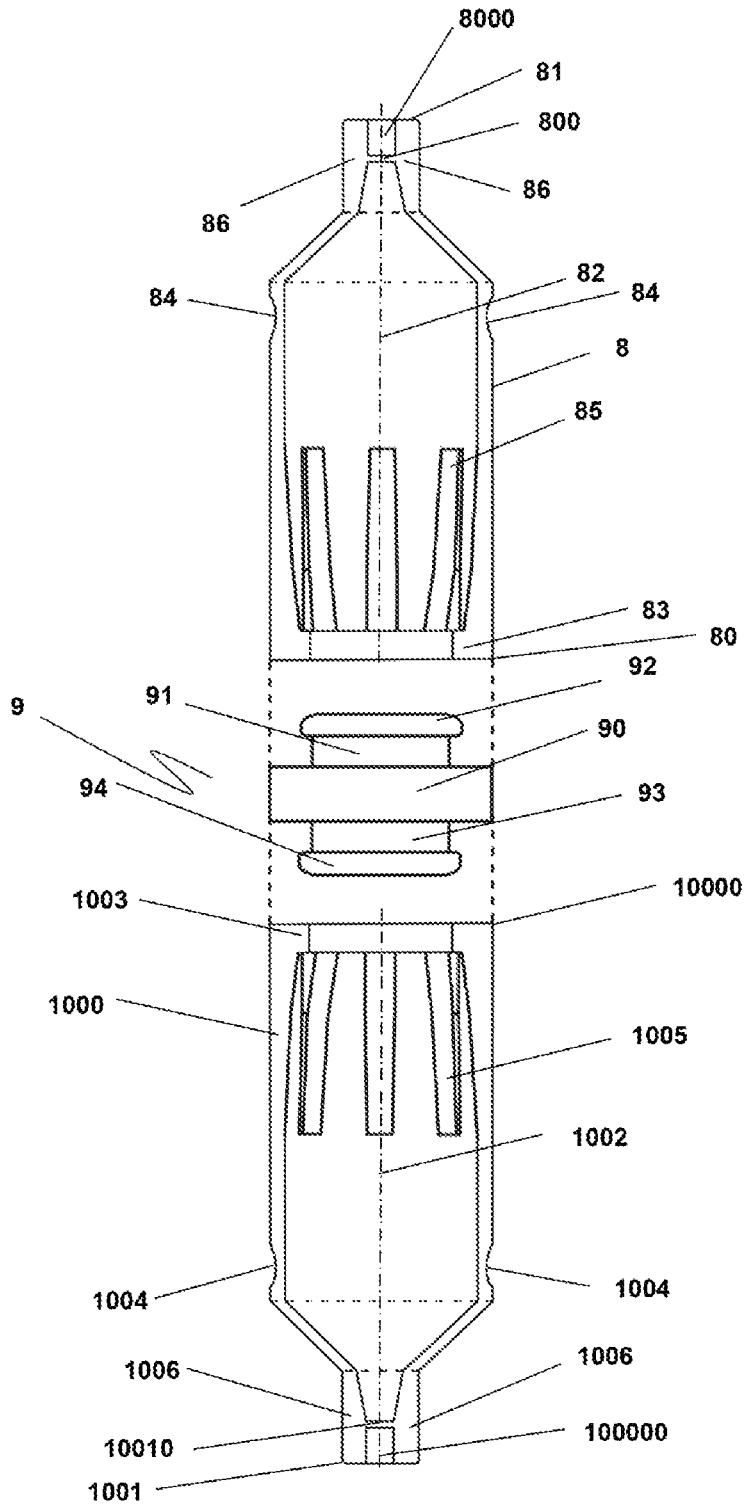
FIG. 14 illustrates a cross-sectional exploded view of a material dispensing device configured in accordance with one or more embodiments of the present disclosure, wherein the cross-section is taken through the line E-E of FIG. 12.

Reference is now being made to FIGS. 12-16, which illustrate other embodiments of a material dispensing device of the present disclosure. The material dispensing device may include a first flexible hollow housing 8 that may include a wall with a proximal end 80 and a distal end 81 having one or more slits 800, a first lip 83 in proximity to the proximal end 80, a first set of plurality of internal ribs 85 distributed longitudinally within an inner surface of the first flexible housing wall and in proximity to the proximal end 80, and a first set of plurality of external ribs 86 in proximity to the distal end 81. The material dispensing device may further include a second flexible hollow housing 1000 that may include a wall with a proximal end 10000 and a distal end 1001 having one or more slits 10010, a second lip 1003 in proximity to the proximal end 10000, a second set of plurality of internal ribs 1005 distributed longitudinally within an inner surface of the first flexible housing wall and in proximity to the proximal end 10000, and a second set of plurality of external ribs 1006 in proximity to the distal end 1001. FIGS. 12-14 further illustrate a first central axis line 82, and a second central axis line 1002 for purposes of describing various features. The first and second set of plurality of internal ribs 85, 1005 may be configured to provide anchoring means to at least a portion of the inside surfaces of the first and second flexible hollow housings 8, 1000, respectively. The material dispensing device may also include a removable connector 9 configured to be separably connected to the proximal ends 80, 10000 of the first and second flexible hollow housings 8, 1000 to define a first compartment and a second compartment within the first and second flexible hollow housings 8, 1000, respectively. The removable connector 9 may include a base 90 with a first protrusion 91 extending perpendicularly therefrom, and a first flange 92 extending radially outwardly from the first protrusion 91. The removable connector 9 may also include a second protrusion 93 extending perpendicularly the base 90 in an opposed direction to the first protrusion 91, and a second flange 94 extending radially outwardly from the second protrusion 93. In embodiments of the present disclosure, the first lip 83 may be configured to circumfuse the first protrusion 91 of the removable connector 9, and the second lip 1003 may be configured to circumfuse the second protrusion 93 of the removable connector 9. This allows for securely connecting the removable connector 9 to the first and second flexible hollow housings 8, 1000 in a separable manner, while preventing the enclosed materials in the first and/or second compartments from leaking to the outside of the first compartment and second compartments through the removable connector 9.

External surfaces of the first and second flexible hollow housings' walls in embodiments of the present disclosure may include one or more recesses 84, 1004 in proximity to the distal ends 81, 1001, respectively.

Figure 15:
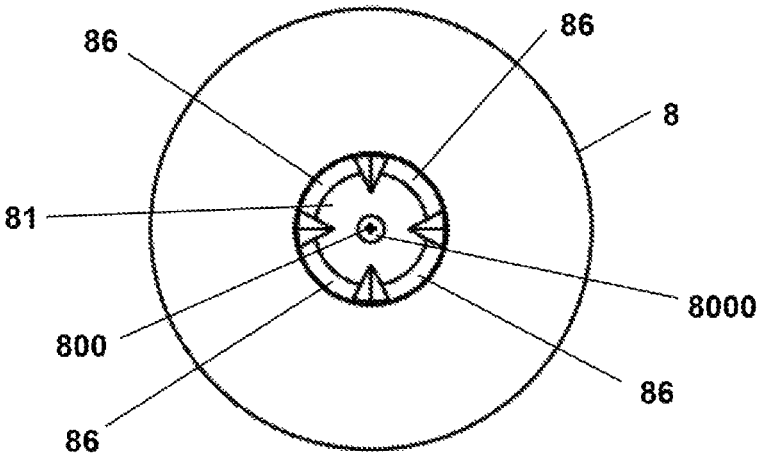
FIG. 15 illustrates a top view of a material dispensing device configured in accordance with one or more embodiments of the present disclosure.

In some embodiments, the one or more slits 800 may have a cross shape and may be slightly displaced from the distal end 81 towards the proximal end 80 with a passageway 8000 defined between the one or more silts 800 and the distal end 81 (FIGS. 14, 15). This configuration may be suitable for dispensing liquid or semi-liquid material enclosed in the first compartment because the passageway 8000 may help in keeping the distal end 81 clean after dispensing the enclosed material, which facilitates the storage of the material dispensing device without the need of wiping the distal end 81 to keep it clean after use.

Figure 16:
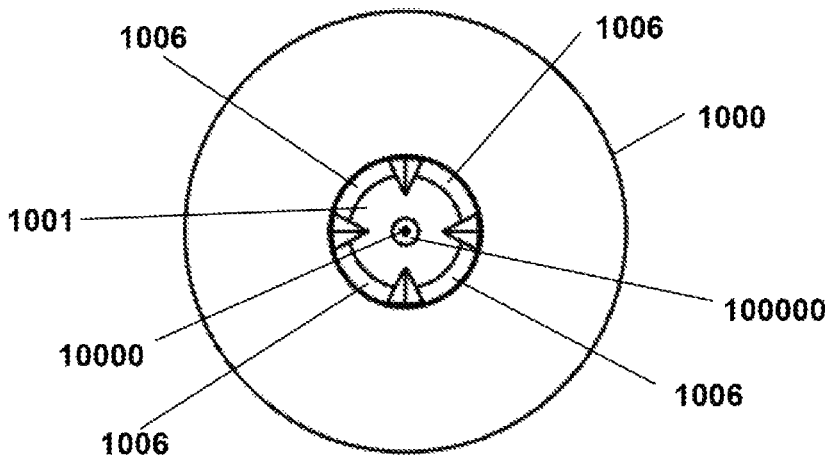
FIG. 16 illustrates a bottom view of a material dispensing device configured in accordance with one or more embodiments of the present disclosure.

Similarly, the one or more slits 10010 may have a cross shape and may be slightly displaced from the distal end 1001 towards the proximal end 10000 with a passageway 100000 defined between the one or more silts 10010 and the distal end 1001 (FIGS. 14, 16). This configuration may be suitable for dispensing liquid or semi-liquid material enclosed in the first compartment because the passageway 100000 may help in keeping the distal end 1001 clean after dispensing the enclosed material, which facilitates the storage of the material dispensing device without the need of wiping the distal end 1001 to keep it clean after use.

In embodiments of the present disclosure, the one or more slits 800, 10010 may be collinear with the first and second central line axes 82, 1002, respectively. The one or more slits 800, 10010 may also be configured to be normally closed, i.e., when there is no lateral force applied in proximity to the distal ends 81, 1001. This may be structurally achieved by means of the first set and second set of the plurality of external ribs 86, 1006, which provide support to the one or more slits 800, 10010 and force the one or more slits 800, 10010 to be firmly closed. The normally closed state of the one or more slits 800, 10010 may prevent the enclosed materials in the first and/or second compartments from being accidently dispensed to the outside of the first and/or second compartments through the one or more slits 800, 10010 when there is no lateral force being applied in proximity to the distal ends 81, 1001.

In embodiments of the present disclosure, the one or more slits 800, 10010 may be configured to open when a user applies a lateral force, i.e., pinch, using his/her thumb and pointer fingers in proximity to the distal ends 81, 1001, e.g., on the one or more recesses 84, 1004. When the one or more slits 800 is open, and when the material dispensing device is oriented such that the distal end 81 has a lower elevation than the proximal end 80, the materials enclosed within the first compartment will flow by gravity to be dispensed from the first compartment to the outside of such compartment through the one or more slits 800. Similarly, when the one or more slits 10010 is open, and when the material dispensing device is oriented such that the distal end 1001 has a lower elevation than the proximal end 10000, the materials enclosed within the second compartment will flow by gravity to be dispensed from the second compartment to the outside of such compartment through the one or more slits 10010.

When a lateral force is applied in proximity to the distal end 81, e.g., on the one or more recesses 84, each member of the first set of plurality of external ribs 86 is forced to slightly move away, i.e., being displaced, from the other members. This forces the one or more slits 800 to open, thus providing a passageway for the enclosed material in the first compartment to be dispensed to the outside of such compartment through the one or more slits 800. Similarly, when a lateral force is applied in proximity to the distal end 1001, e.g., on the one or more recesses 1004, each member of the second set of plurality of external ribs 1006 is forced to slightly move away, i.e., being displaced, from the other members. This forces the one or more slits 10010 to open, thus providing a passageway for the enclosed material in the second compartment to be dispensed to the outside of such compartment through the one or more slits 10010.

In embodiments of the present disclosure, once the user releases the applied lateral force, each member of the first set of plurality of external ribs 86 and/or each member of the second plurality of external ribs 1006 returns to its default/original position and forces the one or more slits 800, 10010 to return to their normally closed position without allowing the enclosed material to pass through. This may allow the material dispensing device to be placed in various orientations while keeping the enclosed materials secure inside the first and/or second compartments.

The magnitude of displacement of each member of the first set of plurality of external ribs 56, 76, and the degree of opening of the one or more slits 800, 10010 merely depend on the magnitude of the lateral force being applied in proximity to the distal ends 81, 1001, e.g., on the one or more recesses 84, 1004. This may give the user control over flow rate of the dispensed materials. Therefore, depending on the magnitude of the applied lateral force, the user can release more or less materials from the dispensing device from the first and/or second compartments as he/she pleases. This may further allow for a simpler and more natural user experience, and improve the usability.

The one or more recesses 84, 1004 may act as a physical guide to the position where the lateral force has to be applied in order for the materials enclosed in the first and/or second compartments to be dispensed from the first and/or second compartments to the outside of such compartments through the one or more slits 800, 10010. The one or more recesses 84, 1004 may also lower the magnitude of the lateral force that should be applied to the first and second flexible housings 8, 1000 in order for the one or more slits 800, 10010 to open.

In embodiments of the present disclosure, the lateral wall thickness of the first and/or second flexible hollow housings 8, 1000 may gradually decrease as going from the proximal ends 80, 10000 towards the distal ends 81, 1001, respectively. This gradual decrease in thickness may render the proximal ends 80, 10000 more rigid than the distal ends 81, 1001. The difference in rigidity between the proximal ends 80, 10000 and the distal ends 81, 1001 may help in sustaining the connection between the removable connector 9 and the first and second flexible hollow housings 8, 1000 when the lateral force is applied in proximity to the distal ends 81, 1001, thus preventing the dispensing device of the present disclosure from accidentally collapsing while in use Additionally, the decrease in lateral wall thickness of the first and/or second hollow housings 8, 1000 may further provide support to keep the removable connector 9 static when lateral forces are applied to the first and/or second flexible hollow housings 8, 1000 in proximity to the proximal ends 80, 10000.

The first and second sets of plurality of internal ribs 85, 1005 may further provide structural support functions to make the proximal ends 80, 10000 more rigid than the distal ends 81, 1001 in order to prevent the dispensing device of the present disclosure from accidentally collapsing due to applied lateral forces on the first and/or second flexible hollow housings 8, 1000 in proximity to the distal ends 81, 1001. Additionally, the first and second sets of plurality of internal ribs 85, 1005 may further provide support to keep the removable connector 9 static when lateral forces are applied to the first and/or second flexible hollow housings 8, 10 in proximity to the proximal ends 80, 10000.

In other embodiments, the first flexible hollow housing 8 may also include a first groove (not shown) in proximity to the proximal end 80, wherein such first groove may be configured to receive a part of the first flange 92 in order to secure a separable connection between the removable connector 9 and the first flexible hollow housing 8.

Similarly, the second flexible hollow housing 1000 may also include a second groove (not shown) in proximity to the proximal end 10000, wherein such second groove may be configured to receive a part of the second flange 94 in order to secure a separable connection between the removable connector 9 and the second flexible hollow housing 1000.

Refilling the materials in the first and/or second compartments may be achieved by simply detaching/disconnecting the first and/or second flexible hollow housings 8, 1000 from the removable connector 9, filling the first and/or second housings 8, 1000 with the materials through the proximal ends 80, 10000, and reattaching/reconnecting the first and/or second flexible hollow housings 8, 1000 to the removable connector 9. Due to the fact that the one or slits 800, 10010 remains naturally closed due to the material properties and geometry of the first and second flexible hollow housings 8, 1000, refilling the material dispensing device will not accidentally release any enclosed material, allowing for a mess free experience.

The configuration of the material dispensing device as described in the different embodiments of the present disclosure may enable one handed users, and visually impaired people to dispense materials enclosed in the first and/or second compartments easily without assistance from other people.

The first and/or second flexible hollow housings 1, 3, 5, 8, 7, 1000 in the different embodiments of the present disclosure may be made of an elastomer, such as, but not limited to food-grade silicon.

The removable caps 2, 4 in the different embodiments of the present disclosure may be made of a rigid material, such as, but not limited to wood, plastic, aluminum, or stainless steel.

The removable connectors 6, 9 in the different embodiments of the present disclosure may be made of a rigid material, such as, but not limited to wood, plastic, aluminum, or stainless steel.

In some of the disclosed embodiments, the materials enclosed in the first and/or second compartments may be either similar or different.

In some of the disclosed embodiments of the present disclosure, the materials enclosed in the first and/or second compartments may include one or more seasoning material.

In other embodiments, the materials enclosed in the first and/or second compartments may include cosmetic materials, glitter, or any other material in granular, powder, gel, cream, liquid, or semi-liquid form.

The description and drawings provided herein are being made to four external ribs in the flexible hollow housings. However, it should be appreciated that the number of external ribs may change according to manufacturing preferences and the type of enclosed materials in the first and/or second compartments.

Furthermore, the description and drawings provided herein are being made cross-shaped one or more slits. However, it should be appreciated that the shape, number, position, and size of the one or more slits depend on the materials being enclosed in the first and/or second compartments, in addition to the number and/or shape of the external ribs.

The description and drawings provided herein are being made for a material dispensing device having a substantially cylindrical shape with a substantially circular profile. However, it should be appreciated that the material dispensing device may also have a conical, prism, pyramid, cube, cuboid, spherical, semi-spherical, or any other polyhedron shape.

As used herein, the term "seasoning material" unless otherwise stated, may refer to any substance in solid, liquid, or semi-liquid form that is added to at least one edible item to enhance its flavor and/or smell, including but not limited to, salt, pepper, herbs, spices, oils, vinegars, fruits, vegetables, beverages, sauces, batters and marinades.

The use of the term "and" in the claims is used to mean "and/or" unless explicitly indicated to refer to collective nature only.

While the present disclosure has been made in detail and with reference to specific embodiments, it will be apparent to those skilled in the art that various additions, omissions, or amendments can be made without departing from the scope and spirit thereof.

What is claimed is:

1. A material dispensing device, comprising:

a first flexible hollow housing, made of an ela5torner, the housing having a first end and a second end and being an outermost, integral surface of the material dispensing device; and a removable cap, base, or connector configured to be separably connected to the first end of the first flexible hollow housing, thus defining a first compartment configured to enclose foodstuff or non-foodstuff materials in solid, granular, powder, semi-liquid, or liquid forms, wherein the first flexible hollow housing extends from the removable cap, base, or connector to the second end at a terminus of the material dispensing device, the terminus being opposite the first end, wherein the first flexible hollow housing comprises integral external ribs, a first slit, and a second slit at the second end, wherein the first flexible hollow housing is configured to be in a closed state and to open when a user applies a manual lateral force to external surfaces of the first flexible hollow housing in proximity to the second end, thus allowing enclosed materials in the first flexible hollow housing to pass through the slits out of the first compartment, wherein the second end comprises a first plurality of the external ribs, integral with the first flexible hollow housing, configured to force the slit to maintain the closed state when no lateral force is applied to external surfaces of the first flexible hollow housing, wherein the slits and the first end each form a cross shape and are collinear with a first central axis line of the first flexible hollow housing, wherein the first plurality of external ribs extend to the second end parallel to the first central axis line, wherein the second end is planar or concave seen along the first central axis line from the second end toward the first end, and wherein the first end comprises a first plurality of internal ribs distributed within an inner surface of the first flexible housing, extending towards the second end from a first lip at the first end in a direction of the first central axis line.

2. The device of claim 1, wherein each member of the plurality of external ribs is configured to be displaced away from other members in the plurality of external ribs when a lateral force is applied to external surfaces of the first flexible hollow housing, thus allowing the first and second slits to open.

3. The device of claim 1, wherein the slits are slightly displaced from the second end towards the first end with a passageway defined between the slit and the second end.

4. The device of claim 1, wherein the first flexible hollow housing further comprises a recess in proximity to the second end.

5. The device of claim 1, wherein a thickness of a wall of the first flexible hollow housing gradually decreases as going from the first end towards the second end.

6. The device of claim 1, wherein the removable cap or connector is present and made of a rigid material selected from wood, aluminum, plastic, or stainless steel, and wherein the removable cap or connector comprises the base, a first protrusion extending perpendicularly from the base, and a first flange extending radially outwardly from the first protrusion.

7. The device of claim 6, wherein the first protrusion is configured to be circumfused by the first lip.

8. The device of claim 1, wherein the first plurality of internal ribs is configured to serve as an anchor to at least a portion of the inside surface of the first flexible hollow housing.

9. The device of claim 1 comprising a first recess and a second recess, configured to allow user control over flow rate of dispensed matelials, on an outer surface of the first flexible hollow housing, and wherein the first plurality of internal ribs provide structural support to make the first end more rigid than the second end.

10. The device of claim 1, further comprising:

a second flexible hollow housing having a third end, proximal to the first end, and a fourth end, distal to the third end, the third end being longitudinally between the fourth end and the first end on the second flexible hollow housing; and wherein the removable connector is present and is configured to be separably connected to the first and third ends of the first and second flexible hollow housings, thus defining the first compartment and a second compartment, wherein the second compartment is configured to enclose a foodstuff or non-foodstuff material in solid, granular, powder, semi-liquid, or liquid forms, wherein the second flexible hollow housing comprises a third slit in proximity to the fourth end, wherein the third slit has a normally closed state and is configured to open when a user applies a manual lateral force to an external surface of the first and/or second flexible hollow housings in proximity to the second and/or fourth end, thus allowing enclosed materials to pass through the slits out of the first and/or second compartments.

11. The device of claim 10, wherein the fourth end of the second flexible hollow housing comprises a plurality of external ribs configured to force the third slit to maintain a normally closed state when no lateral force is applied to the external surface of the first and/or second flexible hollow housings.

12. The device of claim 10, wherein each member of the plurality of external ribs is configured to be displaced away from other members in the plurality of external ribs when the lateral force is applied to the external surface of the first and/or second flexible hollow housings, thus allowing the slits in the first and/or second flexible hollow housings to open.

13. The device of claim 10, wherein the second flexible hollow housing further comprises a fourth slit, wherein the slits of the second flexible hollow housing have a cross shape and are collinear with the first central axis line.

14. The device of claim 10, wherein the third slit is tangent to the fourth end.

15. The device of claim 10, wherein the third slit is slightly displaced from the fourth end towards the third end with a passageway defined between the third slit and the fourth end.

16. The device of claim 10, wherein the second flexible hollow housing comprises a second lip in proximity to the third end of the second flexible hollow housing.

17. The device of claim 10, wherein each of the first flexible hollow housing and the second flexible hollow housing further comprises a recess in proximity to the first and fourth end.

18. The device of claim 10, wherein a thickness of a first wall of the first flexible hollow housing gradually decreases going from the first end towards the second end, and/or wherein a thickness of a second wall of the second flexible hollow housing gradually decreases going from the third end towards the fourth end.

19. The device of claim 10, wherein the second flexible hollow housing further comprises a plurality of internal ribs longitudinally distributed along a circumference of an inner surface of the first and second flexible hollow housing in proximity to the third end.

20. The device of claim 10, wherein each of the first flexible hollow housing and the second flexible hollow housing are made of an elastomer.

21. The device of claim 10, wherein the removable connector is made of a rigid material selected from wood, aluminum, plastic, or stainless steel, and wherein the removable connector comprises the base, a first protrusion extending perpendicularly from the base, a first flange extending radially outwardly from the first protrusion, a second protrusion extending perpendicularly from the base in an opposing direction to the first protrusion, and a second flange extending radially outwardly from the second protrusion.

22. The device of claim 21, wherein the first protrusion is configured to be circumfused by the first lip, and wherein the second protrusion is configured to be circumfused by a second lip.

23. The device of claim 10, wherein the first and second slits are slightly displaced from the second end towards the first end with a passageway defined between the slit and the second end, and wherein the third slit is displaced from the fourth end towards the third end with a passageway defined between the third slit and the fourth end.

24. The device of claim 10, wherein the first and second slits are tangent to the second end, and wherein the third slit is displaced from the fourth end towards the third end with a passageway defined between the third slit and the fourth end.

* * * * *